US010022765B2

(12) United States Patent
Mitsukawa et al.

(10) Patent No.: US 10,022,765 B2
(45) Date of Patent: Jul. 17, 2018

(54) CORRUGATED PLATE MANUFACTURING APPARATUS

(71) Applicant: DENSO CORPORATION, Kariya, Aichi-pref. (JP)

(72) Inventors: Kazuhiro Mitsukawa, Ichinomiya (JP); Masafumi Torimoto, Toyota (JP); Takao Ikeda, Okazaki (JP); Yoshinori Suzuki, Nishio (JE); Koichiro Sato, Takahama (JP); Hidemasa Otsubo, Obu (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 757 days.

(21) Appl. No.: 14/681,384

(22) Filed: Apr. 8, 2015

(65) Prior Publication Data

US 2015/0290693 A1 Oct. 15, 2015

(30) Foreign Application Priority Data

Apr. 9, 2014 (JP) ..... 2014-080221

(51) Int. Cl.

| | |
|---|---|
| ***B21D 13/02*** | (2006.01) |
| ***B21D 13/06*** | (2006.01) |
| ***B21D 53/02*** | (2006.01) |
| ***B21D 17/00*** | (2006.01) |

(52) U.S. Cl.

CPC ..... *B21D 13/02* (2013.01); *B21D 13/06* (2013.01); *B21D 17/00* (2013.01); *B21D 53/02* (2013.01)

(58) Field of Classification Search

CPC ..... B21D 13/02; B21D 13/06; B21D 53/02; B21D 17/00

USPC ..... 72/385

See application file for complete search history.

(56) References Cited

U.S. PATENT DOCUMENTS

| | | | | |
|---|---|---|---|---|
| 7,340,935 | B2 * | 3/2008 | Ohtsuka | B21D 13/02 72/385 |
| 8,424,358 | B2 * | 4/2013 | Motoki | B21D 13/02 72/379.6 |
| 8,973,420 | B2 * | 3/2015 | Nanaarashi | B21D 53/02 72/381 |
| 2006/0193939 | A1 | 8/2006 | Ohtsuka et al. | |
| 2013/0125609 | A1 | 5/2013 | Otsubo et al. | |
| 2013/0180698 | A1 | 7/2013 | Mitsukawa et al. | |
| 2015/0290693 | A1 * | 10/2015 | Mitsukawa | B21D 13/02 72/385 |

FOREIGN PATENT DOCUMENTS

| | | |
|---|---|---|
| JP | 2006-263815 | 10/2006 |
| JP | 2010-264495 | 11/2010 |
| JP | 2013-146736 | 8/2013 |

* cited by examiner

*Primary Examiner* — David B Jones

(74) *Attorney, Agent, or Firm* — Harness, Dickey & Pierce, P.L.C.

(57) ABSTRACT

In a corrugated plate manufacturing apparatus, each of a plurality of primary forming punches includes a plurality of primary pressable portions that are arranged one after another in a slider reciprocating direction and are pressable by a corresponding one of a plurality of primary sliders. When the primary sliders are sequentially moved toward one side in the slider reciprocating direction, each corresponding one of the primary sliders presses the primary pressable portions of the corresponding one of the primary forming punches to press the primary forming punch against a secondary die.

14 Claims, 25 Drawing Sheets

CORRUGATED PLATE MANUFACTURING APPARATUS

CROSS REFERENCE TO RELATED APPLICATION

This application is based on and incorporates herein by reference Japanese Patent Application No. 2014-80221 filed on Apr. 9, 2014.

TECHNICAL FIELD

The present disclosure relates to a corrugated plate manufacturing apparatus, which forms a corrugated metal plate product.

BACKGROUND

There are various known corrugated plate manufacturing apparatuses, which form a corrugated metal plate product that has a corrugated pattern including alternating ridges and furrows through a press forming process. For example, JP2010-264495A discloses one such a manufacturing apparatus. The manufacturing apparatus of JP2010-264495A includes an upper die and a lower die, which are opposed to each other in a top-to-bottom direction. The upper die includes a plurality of press punches, which are stacked one after another in a direction perpendicular to the top-to-bottom direction. The press punches of the upper die are lowered to abut against a processing surface of a block member of the lower die, so that a material of a metal plate product is plastically deformed by a predetermined pressing force applied from the press punches to form the corrugated pattern. At this time, the press punches of the upper die are sequentially lowered toward the lower die at different time points, which are different from each other by a predetermined time difference, so that the corrugated pattern, which includes the alternating ridges and furrows, is formed in the material of the metal plate product.

The corrugated plate manufacturing apparatus of JP2010-264495A forms an inner fin as the corrugated metal plate product. The inner fin is placed in an inside of a tube, which conducts refrigerant and forms a part of a heat exchanger of, for example, a vehicle (e.g., an automobile). Two types of inner fins are exemplified in FIGS. 17 and 18, respectively. In FIGS. 17 and 18, multiple inner fins 90 are joined together by connecting portions 901. The joined multiple inner fins 90 are separated from each other and are placed in the tubes, respectively.

A press forming method of the inner fin is disclosed in, for example, JP2010-264495A. In one example of the press forming method, as shown in FIG. 19, cuttings are formed at predetermined pitches in a rolled metal plate material 92, and the metal plate material 92 is sequentially pulled and pressed to form the corrugated pattern on the metal plate material 92. That is, the metal plate material 92 shown in FIG. 19 is a material of the inner fin 90. As shown in FIG. 20, an upper die 942, which is opposed to a lower die 941, includes a slider 944 that drives press punches 942*a* of the upper die 942 downward. In the press forming process, the slider 944 is slid in the horizontal direction, as indicated by an arrow AR1.

A plurality of cam surfaces 944*a* is integrally formed in the slider 944. A location of each of the cam surfaces 944*a* in a sliding direction (see the arrow AR1) is different from a location of an adjacent one(s) of the cam surfaces 944*a*. Thereby, in the press forming process of the inner fin, the forming timing of each ridge or furrow formed in the inner fin upon lowering of the corresponding press punch 942*a* is shifted from the forming timing of the adjacent ridge or furrow formed in the inner fin upon lowering of the corresponding adjacent press punch 942*a*. Thereby, the corrugated pattern, which includes alternating ridges and furrows, can be formed in the metal plate material 92 without rupturing the metal plate material 92. Here, although the lower die 941 is formed integrally in the corrugated plate manufacturing apparatus shown in FIG. 20, there has been also proposed another type of corrugated plate manufacturing apparatus, in which the lower die 941 includes a plurality of press punches 941*a* like the press punches 942*a* of the upper die 942, as shown in FIG. 21.

Lately, in order to improve the performance of the heat exchanger of the vehicle, a fin pitch Pf (e.g., a ridge-to-ridge pitch or a furrow-to-furrow pitch shown in FIGS. 17 and 18) of the corrugated pattern of the inner fin 90 is reduced, and the number of the ridges Nf (see FIGS. 17 and 18) of the inner fin 90 is increased. As shown in FIGS. 22 to 24, which indicate the structure of the corrugated plate manufacturing apparatus similar to the corrugated plate manufacturing apparatus shown in FIG. 21, the inner fin 90 is formed by the press punches 942*a*, which are stacked one after another in a stacking direction in the upper die 942, and the press punches 941*a*, which are stacked one after another in a stacking direction in the lower die 941. A thickness of each of the press punches 941*a*, 942*a*, i.e., a width THp of each of the press punches 941*a*, 942*a* measured in the stacking direction is determined according to the fin pitch Pf. Therefore, when the fin pitch Pf is reduced, the thickness THp of the respective press punches 941*a*, 942*a* shown in FIGS. 22 to 24 is reduced.

FIG. 22 shows a front view of the corrugated plate manufacturing apparatus. FIG. 23 is a view taken in a direction of an arrow XXIII in FIG. 22. FIG. 24 is a view taken in a direction of an arrow XXIV in FIG. 22. In the corrugated plate manufacturing apparatus shown in FIGS. 22 to 24, the slider 944 of the upper die 942 and a slider 945 of the lower die 941 are formed together as an integral member. The slider 945 drives the press punches 941*a* of the lower die 941 toward the upper die 942. When the sliders 944, 945 are slid in the direction of the arrow AR1, a cam surface 942*b* of each corresponding one of the press punches 942*a* of the upper die 942 is pressed downward by a corresponding one of the cam surfaces 944*a* of the corresponding slider 944. Thereby, the press punches 942*a* of the upper die 942 are sequentially pressed downward toward the lower die 941. At the same time, a cam surface 941*b* of each corresponding one of the press punches 941*a* of the lower die 941 is pressed upward by a corresponding one of the cam surfaces 945*a* of the corresponding slider 945. Thereby, the press punches 941*a* of the lower die 941 are sequentially pressed upward toward the upper die 942.

As discussed above, when the thickness THp of the respective press punches 941*a*, 942*a* is reduced, a pressure receiving surface area of the respective sliding portions, such as the cam surfaces 941*b*, 942*b*, 944*a*, 945*a*, which receive an offset load, is reduced. In such a case, a contact pressure of the sliding portion(s) is increased at, for example, portions X1, X2, X3 shown in FIG. 25, so that galling and wearing are promoted at the sliding portion(s). In addition, when a cam contact force Fc, which is generated at the respective cam surfaces 941*b*, 942*b* (see FIG. 22), is deviated from a center of a press forming load Fp, which plastically deforms the material of the inner fin 90 in a manner shown in FIGS. 22 and 25, the galling and the wearing discussed above are further promoted. The promotion of the galling and the wearing causes a reduction in the lifetime of the upper die 942 and/or the lower die 941.

FIG. 25 is an enlarged partial view showing the lower die 941 of FIG. 22. Although FIG. 25 indicates a stripper 946 of the lower die 941, which guides movement of the respective press punches 941*a* of the lower die 941 in the top-to-bottom direction, the stripper 946 is not shown in FIG. 22 for the sake of simplicity. Furthermore, in FIG. 25, a dot-dot-dash line Lx indicates the press punch 941*a*, which is tilted by the press forming load Fp and the cam contact force Fc.

The inventors of the present application have improved the corrugated plate manufacturing apparatus shown in FIGS. 22 to 24 and have proposed a first corrugated plate manufacturing apparatus shown in FIGS. 26 and 27 and a second corrugated plate manufacturing apparatus shown in FIGS. 28 and 29. FIG. 26 is a front view of the first corrugated plate manufacturing apparatus. FIG. 27 is a view taken in a direction of an arrow XXVII in FIG. 26. Furthermore, FIG. 28 is a front view of the second corrugated plate manufacturing apparatus. FIG. 29 is a view taken in a direction of an arrow XXIX in FIG. 28.

As shown in FIGS. 26 and 27, in the first corrugated plate manufacturing apparatus, two cam surfaces 941*b*, which are arranged one after another in a sliding direction DR3 parallel to the direction of the arrow AR1 (see FIG. 22), are formed at two locations, respectively, in each of the press punches 941*a* in the lower die 941. Also, two cam surfaces 942*b*, which are arranged one after another in the sliding direction DR3, are formed at two locations, respectively, in each of the press punches 942*a* in the upper die 942. Two cam surfaces 944*a*, which are arranged one after another in the sliding direction DR3, are formed at two locations, respectively, in the slider 944 of the upper die 942 to correspond with the two cam surfaces 942*b* of the corresponding press punch 942*a*. Also, two cam surfaces 945*a*, which are arranged one after another in the sliding direction DR3, are formed at two locations, respectively, in the slider 945 of the lower die 941 to correspond with the two cam surfaces 941*b* of the corresponding press punch 941*a*.

Furthermore, in the second corrugated plate manufacturing apparatus shown in FIGS. 28 and 29, three cam surfaces 941*b*, which are arranged one after another in the sliding direction DR3, are formed at three locations, respectively, in each of the press punches 941*a* in the lower die 941. Also, three cam surfaces 942*b*, which are arranged one after another in the sliding direction DR3, are formed at three locations, respectively, in each of the press punches 942*a* in the upper die 942. The second corrugate plate manufacturing apparatus shown in FIGS. 28 and 29 differs from the first corrugated plate manufacturing apparatus shown in FIGS. 26 and 27 with respect to the number of the cam surfaces 941*b* of each press punch 941*a* and the number of the cam surfaces 942*b* of each press punch 942*a*.

As in the cases of the first corrugated plate manufacturing apparatus and the second corrugated plate manufacturing apparatus, when each press punch 941*a*, 942*a* receives the load from the corresponding slider 944, 945 at the multiple cam surfaces 941*b*, 942*b* of the press punch 941*a*, 942*a*, a positional deviation of a resultant force of the cam contact forces Fc, which are generated at the cam surfaces 941*b*, 942*b* of each press punch 941*a*, 942*a*, relative to the center of the press forming load Fp is reduced. Therefore, an increase in the load generated by the galling, which is induced by the positional deviation between the resultant force of the cam contact forces Fc and the center of the press forming load Fp, can be limited, and thereby the contact pressure can be reduced.

However, as shown in FIGS. 26 to 29, in each of the first corrugated plate manufacturing apparatus and the second corrugated plate manufacturing apparatus, in order to shift the forming timing of each ridge or furrow in the inner fin 90 from the forming timing of the adjacent ridge or furrow in the inner fin 90, an interval between the adjacent cam surfaces 941*b*, 942*b* formed at the two or three locations, respectively, in the respective press punches 941*a*, 942*a* is increased. Therefore, a size W2, W3 of each press punch 941*a*, 942*a* in the sliding direction DR3 is substantially increased.

In addition, moment Mp, which acts to tilt the press punch 941*a*, 942*a* relative to the pressing direction that is the top-to-bottom direction, may be generated due to the presence of unequalness of the cam contact forces Fc. The moment Mp is increased when the interval between the two or three locations, at each of which a corresponding one of the cam contacts forces Fc is applied, in the sliding direction DR3 is increased. This moment Mp may become a factor that reduces the lifetime of the press punches 941*a*, 942*a*. That is, when the interval in the sliding direction DR3 between the adjacent cam surfaces 941*b*, 942*b* of the press punch 941*a*, 942*a* pressed by the corresponding slider 944, 945 is increased, the lifetime of the press punch 941*a*, 942*a* is possibly reduced. Furthermore, when the interval between the adjacent cam surfaces 941*b*, 942*b* in the sliding direction DR3 is large, a slight deviation in the timing for pressing the cam surfaces 941*b*, 942*b* of the one press punch 941*a*, 942*a* by the one slider 944, 945 causes generation of the large moment Mp.

SUMMARY

The present disclosure is made in view of the above disadvantages.

According to the present disclosure, there is provided a corrugated plate manufacturing apparatus for forming a corrugated metal plate product that has a corrugated pattern, which includes alternating ridges and furrows that are continuously and alternately arranged one after another. The corrugated plate manufacturing apparatus includes a primary die, a secondary die, a plurality of primary sliders and a primary slider drive portion. The primary die includes a plurality of primary forming punches, which are stacked one after another in a first direction. The secondary die opposes the primary die in a second direction, which is perpendicular to the first direction. The secondary die clamps a material of the corrugated metal plate product between the primary die and the secondary die to deform the material of the corrugated metal plate product and thereby to form the corrugated pattern, which includes the alternating ridges and furrows continuously and alternately arranged one after another in the first direction in the material of the corrugated metal plate product, at a time of forming the corrugated metal plate product. The plurality of primary sliders is arranged one after another in the first direction such that each of the plurality of primary sliders corresponds to each corresponding one of the plurality of primary forming punches. The plurality of primary sliders is movable in a third direction, which intersects the first direction and the second direction. The primary slider drive portion sequentially drives the plurality of primary sliders toward one side in the third direction. Each of the plurality of primary forming punches includes a plurality of primary pressable portions that are arranged one after another in the third direction and are pressable by a corresponding one of the plurality of primary sliders. When the plurality of primary sliders is sequentially moved toward the one side in the third direction, each corresponding one of the plurality of primary sliders presses the plurality of primary pressable portions of each corresponding one of the plurality of primary forming punches to press the primary forming punch against the secondary die.

BRIEF DESCRIPTION OF THE DRAWINGS

The drawings described herein are for illustration purposes only and are not intended to limit the scope of the present disclosure in any way.

DETAILED DESCRIPTION

Figure 1:
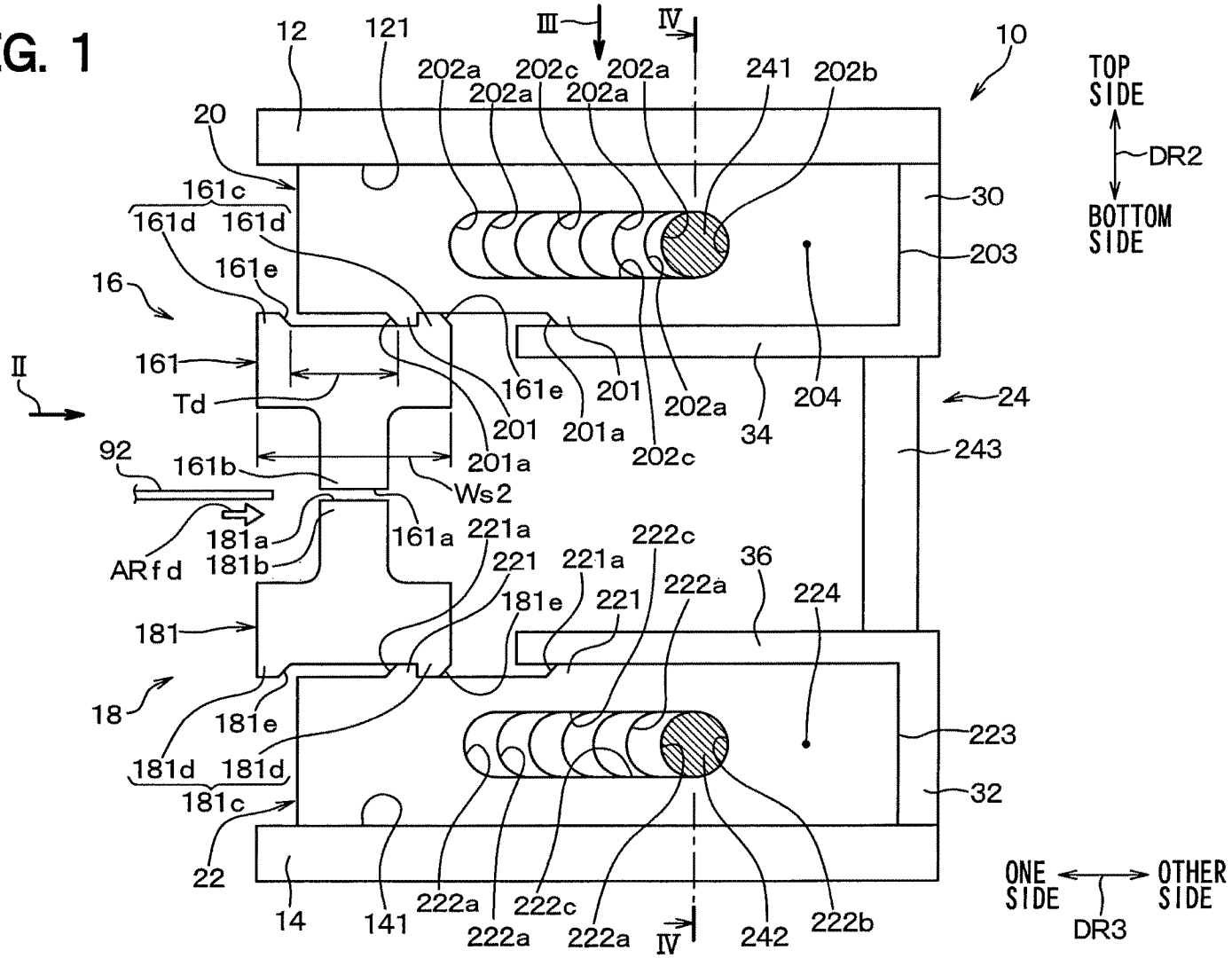
FIG. 1 is a front view of a corrugated plate manufacturing apparatus according to a first embodiment of the present disclosure.

Various embodiments of the present disclosure will be described with reference to the accompanying drawings. In each of the following embodiments, the same or similar components (portions) are indicated by the same reference numerals in the drawing(s).

First Embodiment

Figure 17:
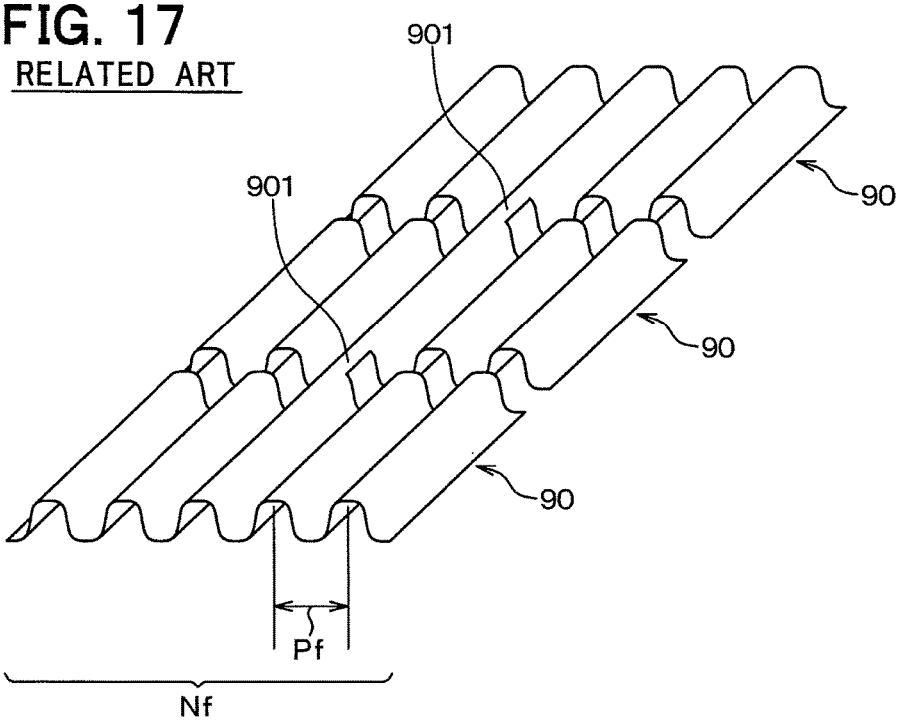
FIG. 17 RELATED ART
FIG. 17 is a perspective view showing a first example of an inner fin manufactured by a corrugated plate manufacturing apparatus in a related art.
Figure 18:
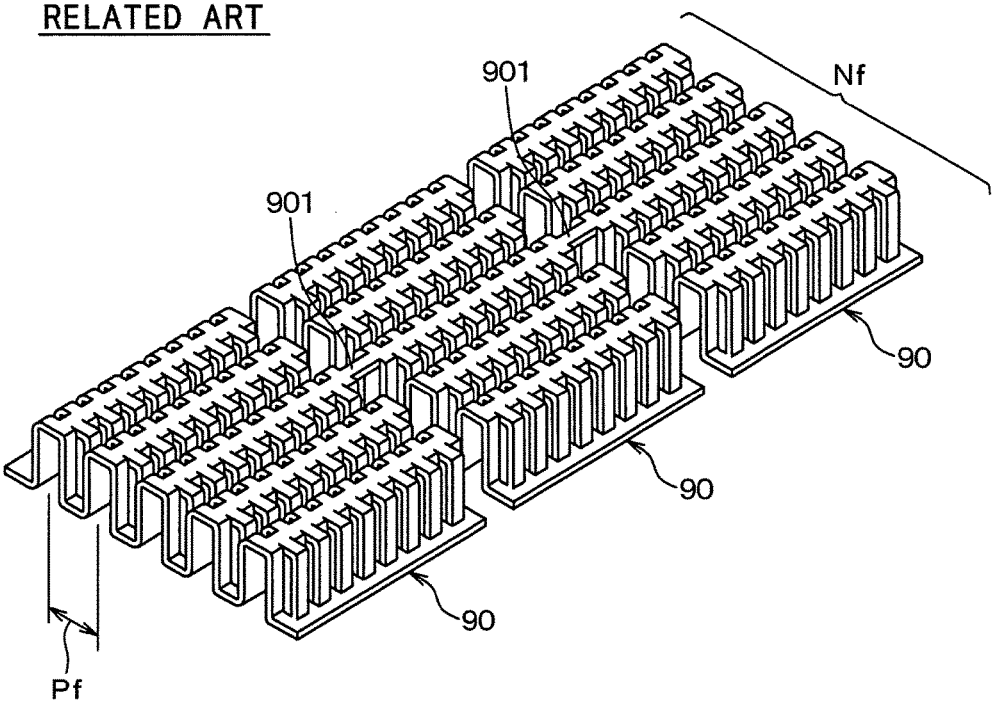
FIG. 18 RELATED ART
FIG. 18 is a perspective view showing a second example of an inner fin manufactured by a corrugated plate manufacturing apparatus in a related art.
Figure 19:
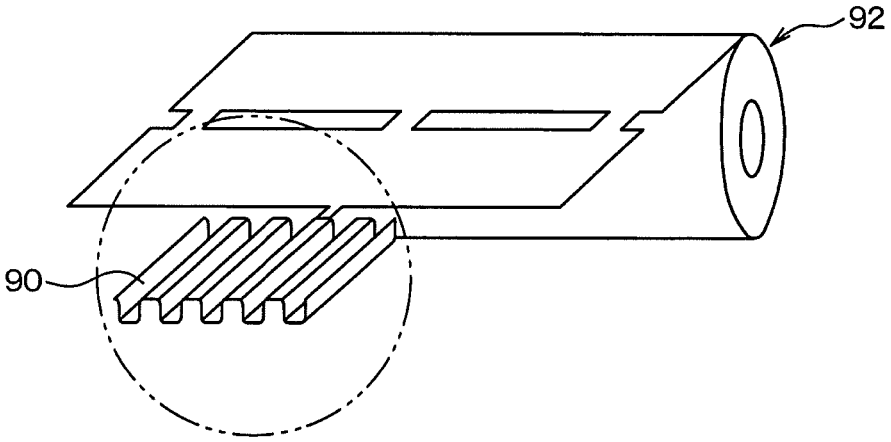
FIG. 19 RELATED ART
FIG. 19 is a perspective view showing a rolled plate material of an inner fin in a related art.
Figure 20:
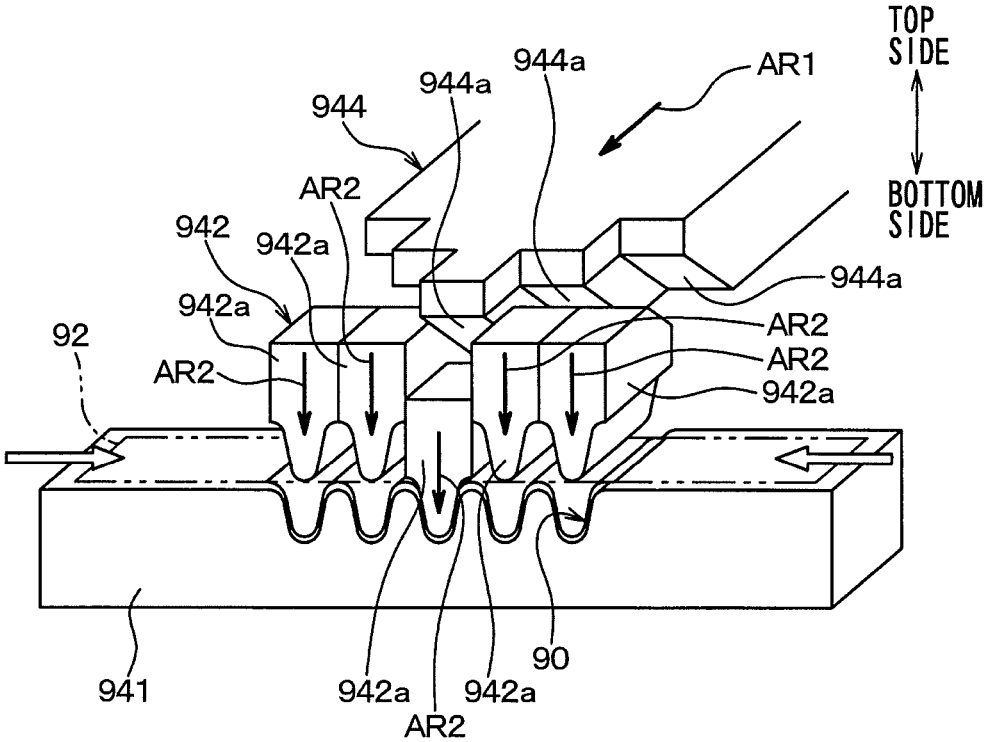
FIG. 20 RELATED ART
FIG. 20 is a perspective view showing a first structure of a lower die and an upper die used for forming an inner fin in a related art.
Figure 21:
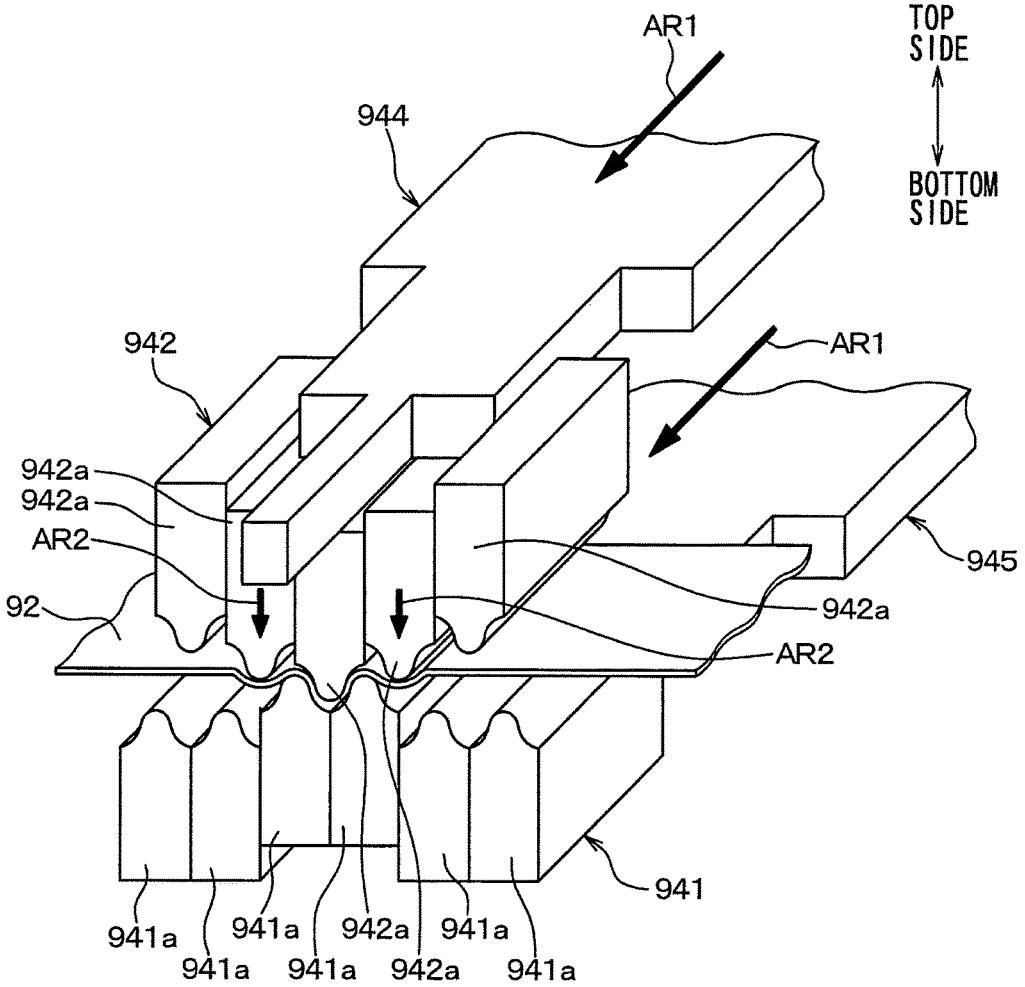
FIG. 21 RELATED ART
FIG. 21 is a perspective view showing a second structure of a lower die and an upper die used for forming an inner fin in a related art.
Figure 22:
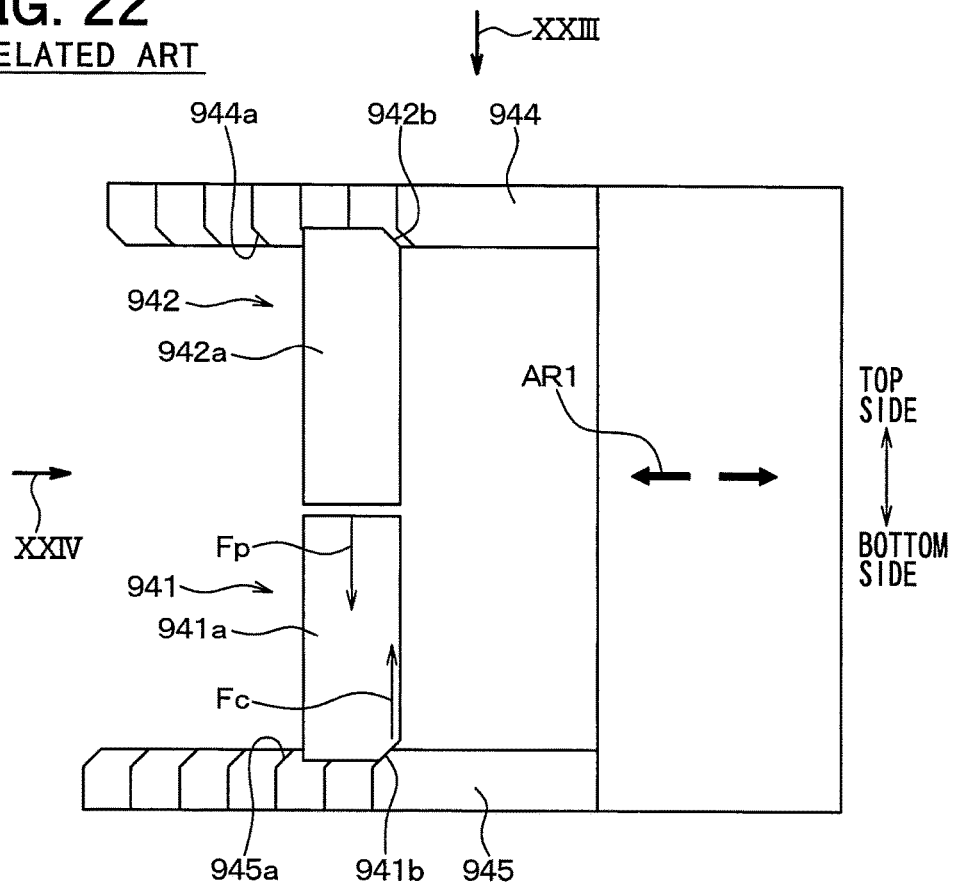
FIG. 22 RELATED ART
FIG. 22 is a front view of a corrugated plate manufacturing apparatus in a related art.
Figure 23:
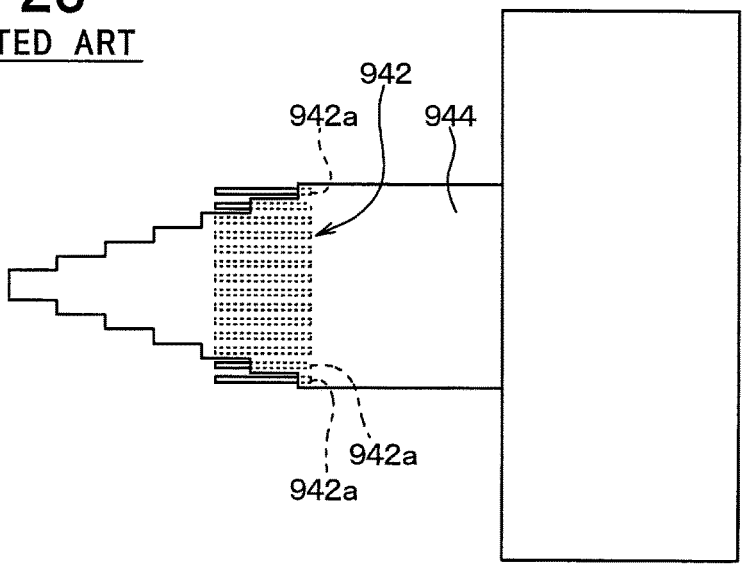
FIG. 23 RELATED ART
FIG. 23 is a view taken in a direction of an arrow XXIII in FIG. 22.
Figure 24:
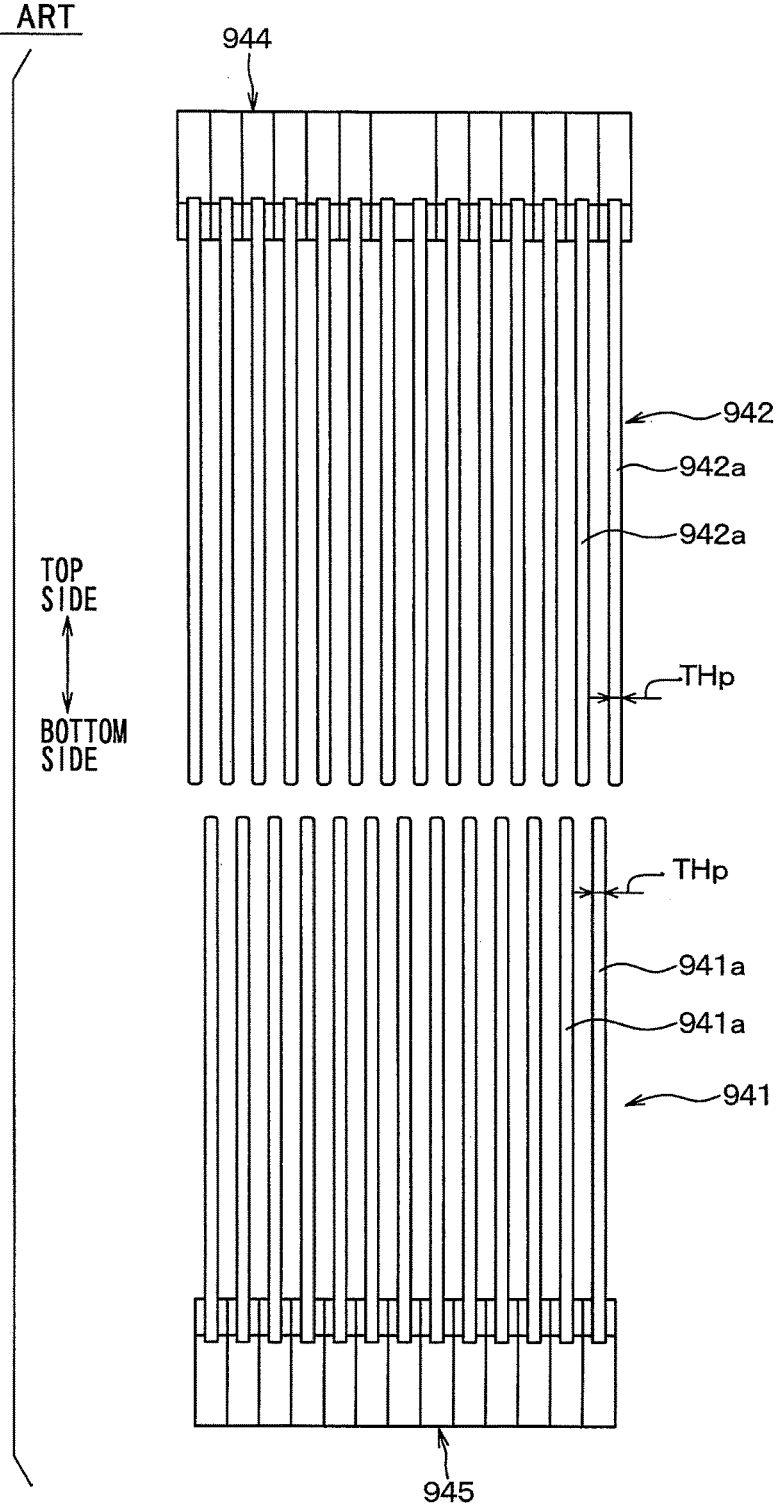
FIG. 24 RELATED ART
FIG. 24 is a view taken in a direction of an arrow XXIV in FIG. 22.

FIG. 1 is a front view of a corrugated plate manufacturing apparatus 10 according to a first embodiment of the present disclosure. The corrugated plate manufacturing apparatus 10 is a press apparatus for manufacturing a corrugated metal plate product that has a corrugated pattern, which includes alternating ridges and furrows that are continuously and alternately arranged one after another to form the corrugated pattern. Specifically, the corrugated plate manufacturing apparatus 10 forms the inner fin (serving as a corrugated metal plate product) 90 of FIG. 17, which is a corrugated metal plate product, by using a metal plate, which is made of an aluminum alloy, as a material 92. The corrugated plate manufacturing apparatus 10 forms the inner fin 90 such that the alternating ridges and furrows are continuously and alternately arranged one after another in a first direction DR1 to form the corrugated pattern (see FIG. 2).

In the corrugated plate manufacturing apparatus 10, a primary die (primary press forming die) 16 and a secondary die (secondary press forming die) 18, which cooperate with each other to form a press forming die device, are moved to open or close the same in a second direction (a top-to-bottom direction in FIG. 1) DR2, and the material 92 of the inner fin 90 is fed in a direction of an arrow ARfd (see FIG. 1) from one side to the other side (another side) in a third direction DR3. The first direction DR1, the second direction DR2 and the third direction DR3 are perpendicular to each other. In the following description, since the first direction DR1 is the same as a stacking direction of a plurality of primary forming punches 161 and a stacking direction of a plurality of secondary forming punches 181 (described later), the first direction DR1 will be also referred to as a punch stacking direction DR1. Furthermore, since the second direction DR2 is the same as the top-to-bottom direction, the second direction DR2 will be also referred to as a top-to-bottom direction DR2. Furthermore, since the third direction DR3 is the same as a reciprocating direction of a plurality of primary sliders 20 and a reciprocating direction of a plurality of secondary sliders 22 (described later), the third direction DR3 will be also referred to as a slider reciprocating direction DR3.

The corrugated plate manufacturing apparatus 10 of FIG. 1 includes a primary base 12, a secondary base 14, the primary die 16, the secondary die 18, the primary sliders 20, the secondary sliders 22, a reciprocating arrangement 24, a primary stopper 30, a secondary stopper 32, a primary slider support portion 34, and a secondary slider support portion 36.

The primary base 12 and the secondary base 14 are formed as backing plates, respectively, which are stationary members that are fixed non-displaceably in all directions. Each of the primary base 12 and the secondary base 14 is configured into a rectangular parallelepiped form. The primary base 12 and the secondary base 14 support the other constituent components of the corrugated plate manufacturing apparatus 10. The primary base 12 is an upper base, which is located at an upper end of the corrugated plate manufacturing apparatus 10, and the secondary base 14 is a lower base, which is located at a lower end of the corrugated plate manufacturing apparatus 10.

The primary base 12 is placed on one side of the primary sliders 20 in the top-to-bottom direction DR2, i.e., is placed on the upper side of the primary sliders 20. A lower surface 121 of the primary base 12 serves as a slide surface, along which the primary sliders 20 slide. The secondary base 14 is symmetrical to the primary base 12 in the top-to-bottom direction. The secondary base 14 is placed on one side of the secondary sliders 22 in the top-to-bottom direction DR2, i.e., is placed on a lower side of the secondary sliders 22. An upper surface 141 of the secondary base 14 serves as a slide surface, along which the secondary sliders 22 slide.

The primary die 16 and the secondary die 18 form the press forming die device, which is used to form the inner fin 90. The primary die 16 and the secondary die 18 are opposed to each other in the top-to-bottom direction DR2. Specifically, the primary die 16 serves as an upper die, and the secondary die 18 serves as a lower die. The material 92 of the inner fin 90 is inserted between the primary die 16 and the secondary die 18 in the direction of the arrow ARfd. The primary die 16 and the secondary die 18 clamp the material 92 of the inner fin 90 therebetween at the time of forming the inner fin 90, so that the material 92 is deformed such that the alternating ridges and furrows are continuously and alternately arranged one after another in the punch stacking direction DR1 to form the corrugated pattern in the material 92.

Figure 2:
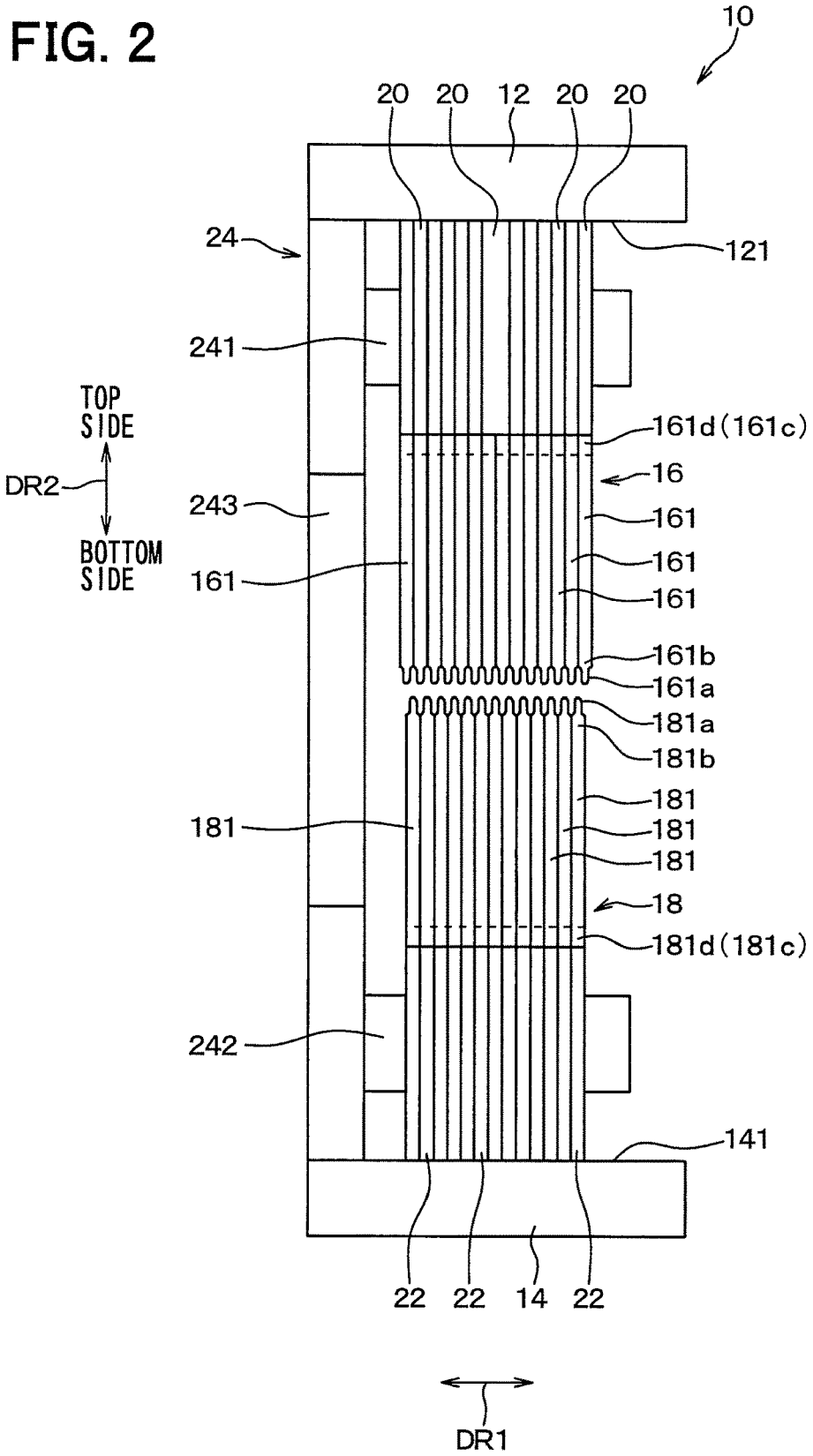
FIG. 2 is a left side view of the corrugated plate manufacturing apparatus of the first embodiment taken in a direction of an arrow II in FIG. 1.

Specifically, as shown in FIG. 2, which is a view taken in a direction of an arrow II in FIG. 1, the primary die 16 includes the primary forming punches 161, which are stacked one after another in the punch stacking direction DR1. As shown in FIGS. 1 and 2, each primary forming punch 161 is configured into a planar plate form where a thickness direction of the primary forming punch 161 coincides with the punch stacking direction DR1. The shapes of the primary forming punches 161 are the same (equal to each other) in the view taken in the punch stacking direction DR1. Each primary forming punch 161 has a distal end processing portion 161*b* at a lower end of the primary forming punch 161, and the distal end processing portion 161*b* has a processing surface 161*a* that contacts the material 92 of the inner fin 90 from the upper side. Each primary forming punch 161 is reciprocatably guided by an undepicted member such that the primary forming punch 161 is reciprocatable in the top-to-bottom direction DR2.

Furthermore, each primary forming punch 161 has a base portion 161*c* at an opposite side, i.e., the upper side, which is opposite from the distal end processing portion 161*b* in the top-to-bottom direction DR2, and the base portion 161*c* includes two primary pressable portions 161*d*. In each primary forming punch 161, one of the two primary pressable portions 161*d* is placed on the one side of the distal end processing portion 161*b* in the slider reciprocating direction DR3, and the other one of the two primary pressable portions 161*d* is placed on the other side of the distal end processing portion 161*b* in the slider reciprocating direction DR3.

The primary pressable portions 161*d* are portions that are pressed by the corresponding primary slider 20. Each primary pressable portion 161*d* includes a pressable surface 161*e* that is tilted relative to the top-to-bottom direction DR2 and the slider reciprocating direction DR3 and is parallel to the punch stacking direction DR1. In FIG. 1, the positions of the pressable surfaces 161*e* of the two primary pressable portions 161*d* in the top-to-bottom direction DR2 and the slider reciprocating direction DR3 are the same for all of the primary forming punches 161. The two pressable surfaces 161*e* of each primary forming punch 161 are formed as planar surfaces, which are parallel to each other. Each primary forming punch 161 is driven by a cam mechanism (not shown) in a direction away from the secondary die 18 synchronously with releasing of the pressing force applied from the corresponding primary slider 20 against the primary forming punch 161. That is, the primary forming punch 161 is moved by the cam mechanism (not shown) to an upper stroke end of the primary forming punch 161.

As shown in FIGS. 1 and 2, the secondary die 18 has the structure, which is similar to the structure of the primary die 16 except that the secondary die 18 is inversed in the top-to-bottom direction with respect to the primary die 16. Specifically, the secondary die 18 includes the secondary forming punches 181, which are stacked one after another in the punch stacking direction DR1. Each secondary forming punch 181 is configured into a planar plate form where a thickness direction of the secondary forming punch 181 coincides with the punch stacking direction DR1. The shapes of the secondary forming punches 181 are the same (equal to each other) in the view taken in the punch stacking direction DR1. Each secondary forming punch 181 has a distal end processing portion 181*b* at an upper end of the secondary forming punch 181, and the distal end processing portion 181*b* has a processing surface 181*a* that contacts the material 92 of the inner fin 90 from the lower side. Each secondary forming punch 181 is reciprocatably guided by an undepicted member such that the secondary forming punch 181 is reciprocatable in the top-to-bottom direction DR2.

Furthermore, each secondary forming punch 181 has a base portion 181*c* at an opposite side, i.e., the lower side, which is opposite from the distal end processing portion 181*b* in the top-to-bottom direction DR2, and the base portion 181*c* includes two secondary pressable portions 181*d*. In each secondary forming punch 181, one of the two secondary pressable portions 181*d* is placed on the one side of the distal end processing portion 181*b* in the slider reciprocating direction DR3, and the other one of the two secondary pressable portions 181*d* is placed on the other side of the distal end processing portion 181*b* in the slider reciprocating direction DR3.

The secondary pressable portions 181*d* are portions that are pressed by the corresponding secondary slider 22. Each secondary pressable portion 181*d* includes a pressable surface 181*e* that is tilted relative to the top-to-bottom direction DR2 and the slider reciprocating direction DR3 and is parallel to the punch stacking direction DR1. In FIG. 1, the positions of the pressable surfaces 181*e* of the two secondary pressable portions 181*d* in the top-to-bottom direction DR2 and the slider reciprocating direction DR3 are the same for all of the secondary forming punches 181. The two pressable surfaces 181*e* of each secondary forming punch 181 are formed as planar surfaces, which are parallel to each other. Each secondary forming punch 181 is driven in a direction away from the primary die 16 by a cam mechanism (not shown) synchronously with releasing of the pressing force applied from the corresponding secondary slider 22 against the secondary forming punch 181. That is, the secondary forming punch 181 is moved by the cam mechanism (not shown) to a lower stroke end of the secondary forming punch 181.

Each primary slider 20 is configured into a planar plate form where a thickness direction of the primary slider 20 coincides with the punch stacking direction DR1, and each primary slider 20 is reciprocatably guided such that the primary slider 20 is reciprocatable in the slider reciprocating direction DR3. In other words, the primary sliders 20 are movable only in the slider reciprocating direction DR3. FIG. 1 shows a state where all of the primary sliders 20 are placed at a stroke end of the primary sliders 20 located at the other side in the slider reciprocating direction DR3, and the secondary sliders 22 are placed at a stroke end of the secondary sliders 22 located at the other side in the slider reciprocating direction DR3. The primary sliders 20 are stacked such that the primary sliders 20 are arranged one after another in the punch stacking direction DR1. Each primary slider 20 serves as a slide cam that drives the corresponding primary forming punch 161. The primary sliders 20 are formed to correspond with the primary forming punches 161, respectively. In other words, each primary slider 20 drives each corresponding specific one of the primary forming punches 161 in the downward direction.

Furthermore, each of the primary sliders 20 includes two primary pressing portions 201 that press the two primary pressable portions 161*d*, respectively, of each corresponding one of the primary forming punches 161. In each primary slider 20, each of the primary pressing portions 201 has a pressing tilt surface 201*a* that is tilted relative to both of the top-to-bottom direction DR2 and the slider reciprocating direction DR3 and is parallel to the punch stacking direction DR1. This pressing tilt surface 201*a* is a planar surface that is parallel to the corresponding pressable surface 161*e* of each corresponding primary forming punch 161. That is, this pressing tilt surface 201*a* is directed in an opposing direction, along which the pressing tilt surface 201*a* is opposed to the corresponding pressable surface 161*e*. Therefore, when the primary slider 20 presses the corresponding primary forming punch 161, this pressing tilt surface 201*a* opposes and contacts the corresponding pressable surface 161*e* of the corresponding primary forming punch 161.

Figure 25:
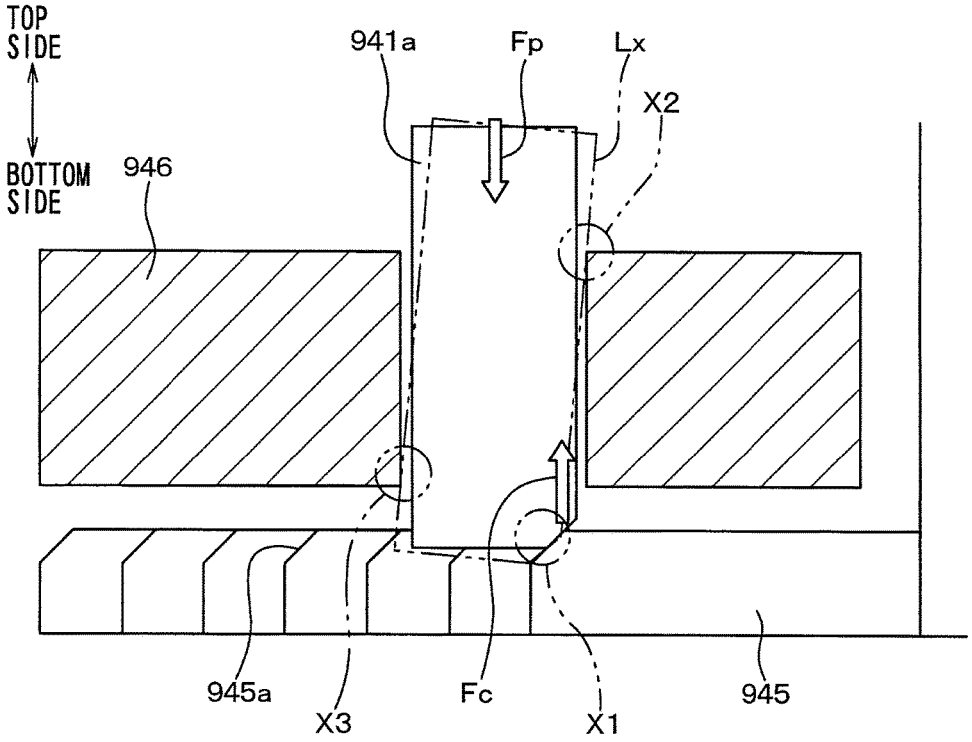
FIG. 25 RELATED ART
FIG. 25 is an enlarged partial view of the corrugated plate manufacturing apparatus of FIG. 22, showing a lower die.

Furthermore, in order to limit generation of the moment load, which tilts the primary forming punch 161 in a manner similar to the one indicated by the dot-dot-dash line Lx (see FIG. 25) discussed above, the two pressable surfaces 161*e* of the primary forming punch 161 are respectively placed at two locations, which are equally spaced from a center point of the distal end processing portion 161*b* in the slider reciprocating direction DR3 (a center point of the distal end processing portion 161*b*, which is centered in the slider reciprocating direction DR3). When the primary slider 20 is slid from the other side to the one side in the slider reciprocating direction DR3, the two pressing tilt surfaces 201*a* of the primary slider 20 simultaneously contact the two pressable surfaces 161*e*, respectively, of the corresponding primary forming punch 161.

Furthermore, in the state where the primary sliders 20 are placed at the stroke end located at the other side in the slider reciprocating direction DR3, the locations of the two pressing tilt surfaces 201*a* are the same, i.e., are identical in the top-to-bottom direction DR2 and in the slider reciprocating direction DR3 for all of the primary sliders 20. In other words, in a state where a primary pressing shaft 241 contacts other-side pressure receiving surfaces (another-side pressure receiving surfaces) 202*b* of all of the primary sliders 20, the two pressing tilt surfaces 201*a* of the primary sliders 20 are overlapped one after another in the punch stacking direction DR1, i.e., are aligned in the punch stacking direction DR1.

It is necessary to provide a feeding time period for feeding the material 92 of the inner fin 90 between the primary forming punches 161 and the secondary forming punches 181 at each shot executed with the primary die 16 and the secondary die 18. Therefore, in the state where the primary sliders 20 are placed at the stroke end located at the other side in the slider reciprocating direction DR3, the pressing tilt surfaces 201*a* of each primary slider 20 are spaced from the pressable surfaces 161*e* of the corresponding primary forming punch 161 that are pressed by the pressing tilt surfaces 201*a*. Specifically, in FIG. 1, each of the pressing tilt surfaces 201*a* of each primary slider 20 is spaced from the corresponding one of the pressable surfaces 161*e* of the corresponding primary forming punch 161 by a spacing distance Td in the slider reciprocating direction DR3.

As shown in FIGS. 1 and 2, the secondary sliders 22 have the structure, which is similar to the structure of the primary sliders 20 except that the secondary sliders 22 are inversed in the top-to-bottom direction relative to the primary sliders 20. Specifically, each secondary slider 22 is configured into a planar plate form where a thickness direction of the secondary slider 22 coincides with the punch stacking direction DR1, and each secondary slider 22 is reciprocatably guided such that the secondary slider 22 is reciprocatable in the slider reciprocating direction DR3. The secondary sliders 22 are stacked such that the secondary sliders 22 are arranged one after another in the punch stacking direction DR1. Each secondary slider 22 serves as a slide cam that drives the corresponding secondary forming punch 181. The secondary sliders 22 are formed to correspond with the secondary forming punches 181, respectively.

Furthermore, each of the secondary sliders 22 includes two secondary pressing portions 221 that press the two secondary pressable portions 181*d*, respectively, of the corresponding one of the secondary forming punches 181. In each secondary slider 22, each of the secondary pressing portions 221 has a pressing tilt surface 221*a* that is tilted relative to both of the top-to-bottom direction DR2 and the slider reciprocating direction DR3 and is parallel to the punch stacking direction DR1. This pressing tilt surface 221*a* is a planar surface that is parallel to the corresponding pressable surface 181*e* of the corresponding secondary forming punch 181. That is, this pressing tilt surface 221*a* is directed in an opposing direction, along which the pressing tilt surface 221*a* is opposed to the corresponding pressable surface 181*e*. Therefore, when the secondary slider 22 presses the corresponding secondary forming punch 181, this pressing tilt surface 221*a* opposes and contacts the corresponding pressable surface 181*e* of the corresponding secondary forming punch 181.

Furthermore, in order to limit generation of the moment load, which tilts the secondary forming punch 181 in a manner similar to the one indicated by the dot-dot-dash line Lx (see FIG. 25) discussed above, the two pressable surfaces 181*e* of the secondary forming punch 181 are respectively placed at two locations, which are equally spaced from a center point of the distal end processing portion 181*b* in the slider reciprocating direction DR3 (a center point of the distal end processing portion 181*b*, which is centered in the slider reciprocating direction DR3). When the secondary slider 22 is slid from the other side to the one side in the slider reciprocating direction DR3, the two pressing tilt surfaces 221*a* of the secondary slider 22 simultaneously contact the two pressable surfaces 181*e*, respectively, of the corresponding secondary forming punch 181.

Furthermore, in the state where the secondary sliders 22 are placed at the stroke end located at the other side in the slider reciprocating direction DR3, the locations of the two pressing tilt surfaces 221*a* are the same in the top-to-bottom direction DR2 and in the slider reciprocating direction DR3 for all of the secondary sliders 22. In other words, in a state where a secondary pressing shaft 242 contacts other-side pressure receiving surfaces (another-side pressure receiving surfaces) 222*b* of all of the secondary sliders 22, the two pressing tilt surfaces 221*a* of the secondary sliders 22 are overlapped one after another in the punch stacking direction DR1, i.e., are aligned in the punch stacking direction DR1.

Furthermore, in the state where the secondary sliders 22 are placed at the stroke end located at the other side in the slider reciprocating direction DR3, the pressing tilt surfaces 221*a* of each secondary slider 22 are spaced from the pressable surfaces 181*e* of the corresponding secondary forming punch 181 that are pressed by the pressing tilt surfaces 221*a*.

As shown in FIGS. 1 and 2, the reciprocating arrangement 24 is a drive mechanism that reciprocates the primary sliders 20 and the secondary sliders 22 in the slider reciprocating direction DR3 and includes the primary pressing shaft 241, the secondary pressing shaft 242 and a shaft support portion 243. The reciprocating arrangement 24 is continuously reciprocated by, for example, an external power source in the reciprocating portion DR3. The shaft support portion 243 is placed on one side of the primary die 16 and the secondary die 18 in the punch stacking direction DR1 and is reciprocated in the slider reciprocating direction DR3 by a drive source (not shown). The primary pressing shaft 241, the secondary pressing shaft 242 and the shaft support portion 243 are integrally fixed together. Therefore, the primary pressing shaft 241 and the secondary pressing shaft 242 are reciprocated in the slider reciprocating direction DR3 simultaneously with the shaft support portion 243.

Figure 3:
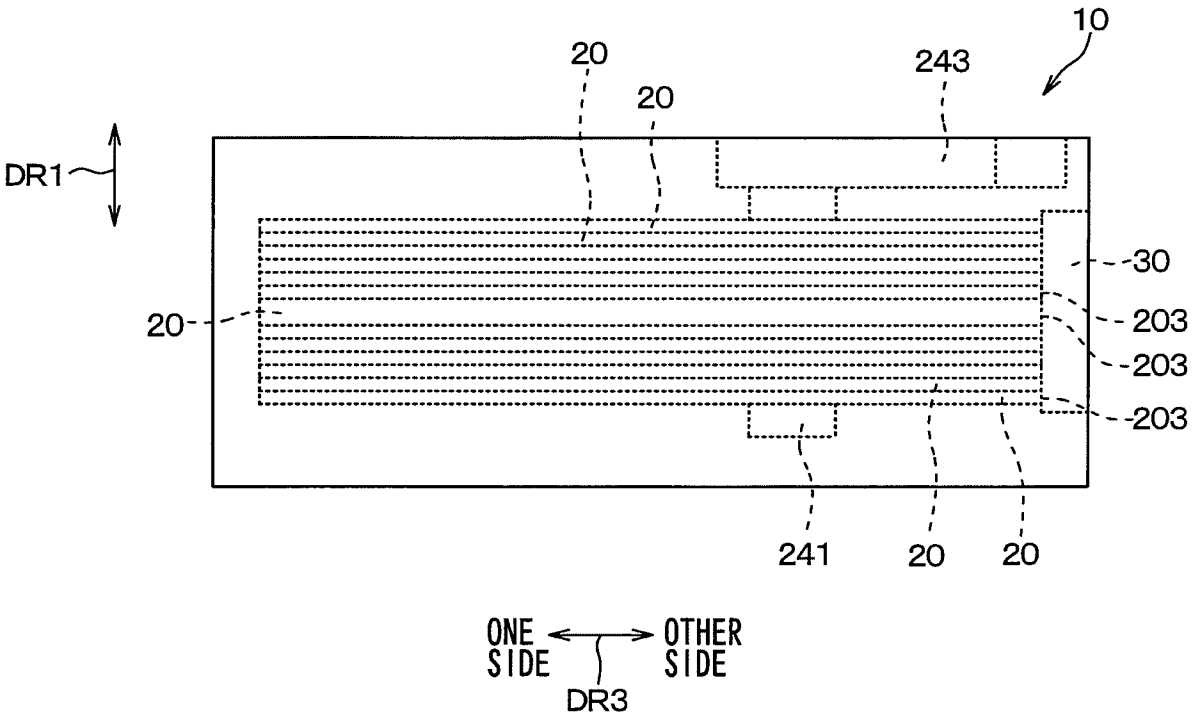
FIG. 3 is a plan view of the corrugated plate manufacturing apparatus of the first embodiment taken in a direction of an arrow III in FIG. 1.
Figure 4:
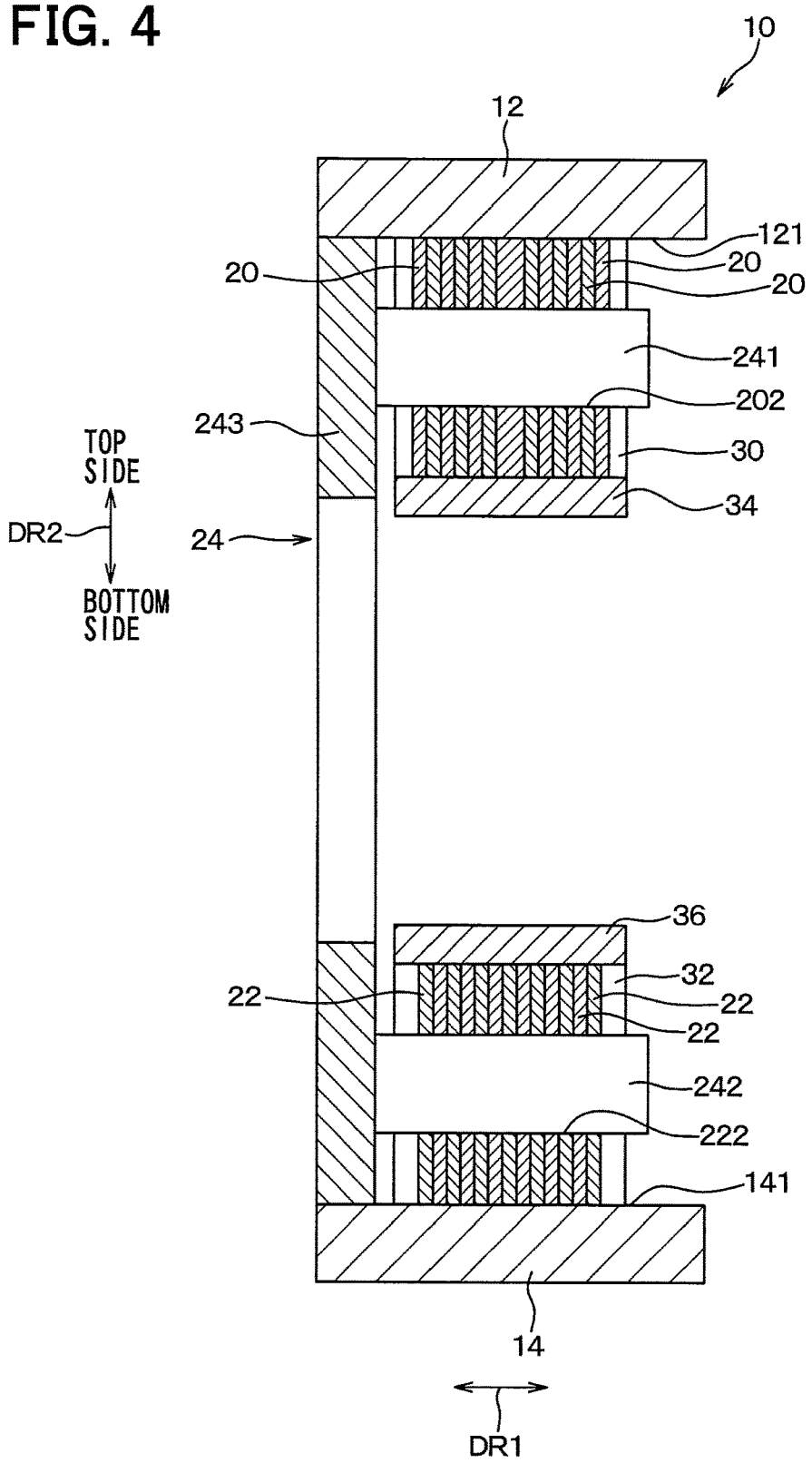
FIG. 4 is a cross sectional view taken along line IV-IV in FIG. 1.

The primary pressing shaft 241 serves as a primary slider drive portion, which reciprocates the primary sliders 20. The primary pressing shaft 241 projects from the shaft support portion 243 toward the primary die 16 in the punch stacking direction DR1. The primary pressing shaft 241 is a column member (rod member) that is configured into a cylindrical column form (cylindrical rod form). The primary pressing shaft 241 is received through through-holes 202 of the primary sliders 20, as shown in FIGS. 3 and 4. FIG. 3 is a view taken in a direction of an arrow III in FIG. 1, and FIG. 4 is a cross-sectional view taken along line IV-IV in FIG. 1.

A size of the through-hole 202 of each primary slider 20, which is measured in the top-to-bottom direction DR2, is slightly larger than a size of the primary pressing shaft 241, which is measured in the top-to-bottom direction DR2, so that the primary sliders 20 are not fixed relative to the primary pressing shaft 241 in the top-to-bottom direction DR2. As shown in FIG. 1, the through-holes 202 of the primary sliders 20 are configured into an ellipse shape or a circular shape and have different lengths, respectively, in the slider reciprocating direction DR3. Specifically, the through-hole 202 of each primary slider 20 (except a center one of the primary sliders 20 discussed below) has the one-side pressure receiving surface 202*a*, which is configured into a semicircular shape, the other-side pressure receiving surface 202*b*, which is configured into a semicircular shape, and a pair of connecting side surfaces 202*c*, which connect between the one-side pressure receiving surface 202*a* and the other-side pressure receiving surface 202*b*. An interval (a surface-to-surface interval) between the one-side pressure receiving surface 202*a* and the other-side pressure receiving surface 202*b* is set differently for the individual primary sliders 20 (is set differently for each corresponding one of the primary sliders 20). The center one (also referred to as a center primary slider) of the primary sliders 20, which is centered in the row of the primary sliders 20 in the stacking direction DR1 of the primary sliders 20, has the shortest surface-to-surface interval between the one-side pressure receiving surface 202*a* and the other-side pressure receiving surface 202*b*, and the through-hole 202 of the center one of the primary sliders 20 is configured into the circular shape. Therefore, in the center one of the primary sliders 20, the connecting side surfaces 202*c* are absent, and thereby the one-side pressure receiving surface 202*a* and the other-side pressure receiving surface 202*b* are directly connected with each other.

Furthermore, in the present embodiment, the number of the primary sliders 20 is thirteen. Six of the primary sliders 20 are placed on one side (the left side in FIG. 6) of the center primary slider 20 and are referred to as first to sixth one-side primary sliders 20, which are arranged one after another in this order from the inner side, at which the center primary slider 20 is placed, toward the outer side (the left side in FIG. 6) in the punch stacking direction DR1. Furthermore, other six of the primary sliders 20 are placed on the other side (the right side in FIG. 6) of the center primary slider 20 and are referred to as first to sixth other-side primary sliders (also referred to as first to sixth another-side primary sliders) 20, which are arranged one after another in this order from the inner side, at which the center primary slider 20 is placed, toward the outer side (the right side in FIG. 6) in the punch stacking direction DR1. The through-holes 202 of the first to sixth one-side primary sliders 20 are identical to the through-holes 202 of the first to sixth other-side primary sliders 20, respectively, in terms of the shape, the size and the location of the through-hole 202 in the primary slider 20. Thus, the surface-to-surface intervals (i.e., the interval between the one-side pressure receiving surface 202*a* and the other-side pressure receiving surface 202*b*) of the first to sixth one-side primary sliders 20 are identical to the surface-to-surface intervals of the first to sixth other-side primary sliders 20, respectively.

In each of the primary sliders 20, the one-side pressure receiving surface 202*a* is opposed to the other-side pressure receiving surface 202*b* in the slider reciprocating direction DR3 while the primary pressing shaft 241 is interposed between the one-side pressure receiving surface 202*a* and the other-side pressure receiving surface 202*b* in the slider reciprocating direction DR3. The one-side pressure receiving surface 202*a* is a pressure receiving surface that is pressed by the primary pressing shaft 241 toward the one side in the slider reciprocating direction DR3. The primary pressing shaft 241 drives each corresponding one of the primary sliders 20 toward the one side in the slider reciprocating direction DR3 by pressing the one-side pressure receiving surface 202*a* of the primary slider 20. The other-side pressure receiving surface 202*b* is a pressure receiving surface that is pressed by the primary pressing shaft 241 toward the other side in the slider reciprocating direction DR3. The primary pressing shaft 241 drives each corresponding one of the primary sliders 20 toward the other side in the slider reciprocating direction DR3 by pressing the other-side pressure receiving surface 202*b* of the primary slider 20.

The surface-to-surface interval between the one-side pressure receiving surface 202*a* and the other-side pressure receiving surface 202*b* progressively increases from the center one of the primary sliders 20 toward each of two outermost ones (i.e., the sixth one-side primary slider 20 and the sixth other-side primary slider 20, which are also referred to as outermost primary sliders) of the primary sliders 20, which are located on the one side and the other side, respectively, of the center one of primary sliders 20 in the punch stacking direction DR1 and are farthest from the center one of the primary sliders 20 in the punch stacking direction DR1 in the row of the primary sliders 20. Now, the details of the pressure receiving surfaces 202*a*, 202*b* will be described. A positional relationship of the other-side pressure receiving surface 202*b* relative to each corresponding one of the primary pressing portions 201 in the slider reciprocating direction DR3 is set to be equal (identical) for each of the primary sliders 20. Here, it should be noted that the meaning of "equal" is not necessarily limited to "completely equal" but implies "generally equal." In other words, as shown in FIG. 1, in the state where the primary sliders 20 are at the stroke end of the primary sliders 20 located at the other side in the slider reciprocating direction DR3, the other-side pressure receiving surfaces 202*b* of all of the primary sliders 20 contact the primary pressing shaft 241, and the position of the other-side pressure receiving surface 202*b* in the slider reciprocating direction DR3 is identical for all of the primary sliders 20.

In contrast, a positional relationship of the one-side pressure receiving surface 202*a* relative to each corresponding one of the primary pressing portions 201 in the slider reciprocating direction DR3 is set differently for each corresponding one of the primary sliders 20. Therefore, when the primary pressing shaft 241 is moved toward the one side in the slider reciprocating direction DR3, the primary pressing shaft 241 sequentially drives the primary sliders 20 at different operational timing toward the one side in the slider reciprocating direction DR3 by pressing the one-side pressure receiving surface 202*a* of each corresponding primary slider 20. That is, the operational timing of each of the primary sliders 20 is shifted (i.e., is changed) from the operational timing of the previously moved primary slider 20 or the operational timing of the subsequently moved primary slider 20.

Specifically, in any outer one of the primary sliders 20, which is placed on an outer side in the row of the primary sliders 20 in the punch stacking direction DR1, the one-side pressure receiving surface 202*a* is further displaced toward the one side in the slider reciprocating direction DR3 with reference to a reference position, which is a position of one of the two primary pressing portions 201 of the primary slider 20. In other words, in the state where all of the primary sliders 20 are placed at the stroke end of the primary sliders 20 located at the other side in the slider reciprocating direction DR3, the one-side pressure receiving surface 202*a* of an outer one of every adjacent two of the primary sliders 20, which is placed on an outer side of the other one (another one) of the adjacent two of the primary sliders 20 in the punch stacking direction DR1, is located on the one side of the one-side pressure receiving surface 202*a* of the other one of the adjacent two of the primary sliders 20 in the slider reciprocating direction DR3.

Thus, when the primary pressing shaft 241 is moved toward the one side in the slider reciprocating direction DR3, the primary pressing shaft 241 initially drives the center primary slider 20, which is centered in the row of the primary sliders 20 in the punch stacking direction DR1, toward the one side in the slider reciprocating direction DR3. Then, the primary pressing shaft 241 sequentially drives the remaining ones (the second to sixth one-side primary sliders 20 and the second to sixth other-side primary sliders 20) of the primary sliders 20 one after another toward the one side in the slider reciprocating direction DR3 starting with the center side one and ending with the outermost one of the primary sliders 20 in the punch stacking direction DR1 on each of the one side and the other side of the center primary slider 20. In other words, the primary pressing shaft 241 sequentially drives the primary sliders 20 in an order starting with the center primary slider 20 and ending with the two outermost primary sliders 20 (i.e., the sixth one-side primary slider 20 and the sixth other-side primary slider 20) in the punch stacking direction DR1.

The secondary pressing shaft 242 is constructed in a manner similar to that of the primary pressing shaft 241. That is, the secondary pressing shaft 242 serves as a secondary slider drive portion, which reciprocates the secondary sliders 22. The secondary pressing shaft 242 projects from the shaft support portion 243 toward the secondary die 18 in the punch stacking direction DR1. The secondary pressing shaft 242 is a column member (rod member) that is configured into a cylindrical column form (cylindrical rod form). The secondary pressing shaft 242 is received through through-holes 222 of the secondary sliders 22, as shown in FIG. 4.

The through-holes 222 of the secondary sliders 22 are constructed in a manner similar to that of the through-holes 202 of the primary sliders 20. That is, as shown in FIG. 1, the through-holes 222 of the secondary sliders 22 are configured into an ellipse shape or a circular shape and have different lengths, respectively, in the slider reciprocating direction DR3. The through-hole 222 of each secondary slider 22 (except a center one of the secondary sliders 22 discussed below) has the one-side pressure receiving surface 222*a*, which is configured into a semicircular shape, the other-side pressure receiving surface 222*b*, which is configured into a semicircular shape, and a pair of connecting side surfaces 222*c*, which connect between the one-side pressure receiving surface 222*a* and the other-side pressure receiving surface 222*b*. An interval (a surface-to-surface interval) between the one-side pressure receiving surface 222*a* and the other-side pressure receiving surface 222*b* is set differently for the individual secondary sliders 22 (is set differently for each corresponding one of the secondary sliders 22). The center one (also referred to as a center secondary slider) of the secondary sliders 22, which is centered in the row of the secondary sliders 22 in the stacking direction DR1 of the secondary sliders 22, has the shortest surface-to-surface interval between the one-side pressure receiving surface 222*a* and the other-side pressure receiving surface 222*b*, and the through-hole 222 of the center one of the secondary sliders 22 is configured into the circular shape. Therefore, in the center one of the secondary sliders 22, the connecting side surfaces 222*c* are absent, and thereby the one-side pressure receiving surface 222*a* and the other-side pressure receiving surface 222*b* are directly connected with each other.

Furthermore, in the present embodiment, the number of the secondary sliders 22 is thirteen. Six of the secondary sliders 22 are placed on one side (the left side in FIG. 6) of the center secondary slider 22 and are referred to as first to sixth one-side secondary sliders 22, which are arranged one after another in this order from the inner side, at which the center secondary slider 22 is placed, toward the outer side (the left side in FIG. 6) in the punch stacking direction DR1. Furthermore, other six of the secondary sliders 22 are placed on the other side (the right side in FIG. 6) of the center secondary slider 22 and are referred to as first to sixth other-side secondary sliders (also referred to as first to sixth another-side secondary sliders) 22, which are arranged one after another in this order from the inner side, at which the center secondary slider 22 is placed, toward the outer side (the right side in FIG. 6) in the punch stacking direction DR1. The through-holes 222 of the first to sixth one-side secondary sliders 22 are identical to the through-holes 222 of the first to sixth other-side secondary sliders 22, respectively, in terms of the shape, the size and the location of the through-hole 222 in the secondary slider 22. Thus, the surface-to-surface intervals (i.e., the interval between the one-side pressure receiving surface 222*a* and the other-side pressure receiving surface 222*b*) of the first to sixth one-side secondary sliders 22 are identical to the surface-to-surface intervals of the first to sixth other-side secondary sliders 22, respectively.

In each of the secondary sliders 22, the one-side pressure receiving surface 222*a* is opposed to the other-side pressure receiving surface 222*b* in the slider reciprocating direction DR3 while the secondary pressing shaft 242 is interposed between the one-side pressure receiving surface 222*a* and the other-side pressure receiving surface 222*b* in the slider reciprocating direction DR3. The one-side pressure receiving surface 222*a* is a pressure receiving surface that is pressed by the secondary pressing shaft 242 toward the one side in the slider reciprocating direction DR3. The other-side pressure receiving surface 222*b* is a pressure receiving surface that is pressed by the secondary pressing shaft 242 toward the other side in the slider reciprocating direction DR3.

Furthermore, the one-side pressure receiving surfaces 222*a* of the secondary sliders 22 are constructed in a manner similar to that of the one-side pressure receiving surfaces 202*a* of the primary sliders 20. Also, the other-side pressure receiving surfaces 222*b* of the secondary sliders 22 are constructed in a manner similar to that of the other-side pressure receiving surfaces 202*b* of the primary sliders 20. The pressing timing of each of the primary forming punches 161 is slightly different from the pressing timing of the corresponding one of the secondary forming punches 181. Therefore, the positions of the one-side pressure receiving surfaces 222*a* of the secondary sliders 22 in the slider reciprocating direction DR3 are not identical to the positions of the one-side pressure receiving surfaces 202*a* of the primary sliders 20.

Now, the details of the pressure receiving surfaces 222*a*, 222*b* will be described. A positional relationship of the other-side pressure receiving surface 222*b* relative to each of the secondary pressing portion 221 in the slider reciprocating direction DR3 is set to be equal (identical) for each of the secondary sliders 22. In other words, as shown in FIG. 1, in the state where the secondary sliders 22 are at the stroke end of the secondary sliders 22 located at the other side in the slider reciprocating direction DR3, the other-side pressure receiving surfaces 222*b* of all of the secondary sliders 22 contact the secondary pressing shaft 242, and the position of the other-side pressure receiving surface 222*b* in the slider reciprocating direction DR3 is identical for all of the secondary sliders 22.

In contrast, a positional relationship of the one-side pressure receiving surface 222*a* relative to each of the secondary pressing portions 221 in the slider reciprocating direction DR3 is set differently for each corresponding one of the secondary sliders 22. Therefore, when the secondary pressing shaft 242 is moved toward the one side in the slider reciprocating direction DR3, the secondary pressing shaft 242 sequentially drives the secondary sliders 22 at different operational timing toward the one side in the slider reciprocating direction DR3 by pressing the one-side pressure receiving surface 222*a* of each corresponding secondary slider 22. Thus, similar to the primary sliders 20, in the state where all of the secondary sliders 22 are placed at the stroke end of the secondary sliders 22 located at the other side in the slider reciprocating direction DR3, the one-side pressure receiving surface 222*a* of an outer one of every adjacent two of the secondary sliders 22, which is placed on an outer side of the other one (another one) of the adjacent two of the secondary sliders 22 in the punch stacking direction DR1, is located on the one side of the one-side pressure receiving surface 222*a* of the other one of the adjacent two of the secondary sliders 22 in the slider reciprocating direction DR3.

Specifically, similar to the relationship between the primary pressing shaft 241 and the primary sliders 20, when the secondary pressing shaft 242 is moved toward the one side in the slider reciprocating direction DR3, the secondary pressing shaft 241 initially drives the center secondary slider 22, which is centered in the row of the secondary sliders 22 in the punch stacking direction DR1, toward the one side in the slider reciprocating direction DR3. Then, the secondary pressing shaft 242 sequentially drives the remaining ones (the second to sixth one-side secondary sliders 22 and the second to sixth other-side secondary sliders 22) of the secondary sliders 22 one after another toward the one side in the slider reciprocating direction DR3 starting with the center side one and ending with the outermost one of the secondary sliders 22 in the punch stacking direction DR1 on each of the one side and the other side of the center secondary slider 22. In other words, the secondary pressing shaft 242 sequentially drives the secondary sliders 22 in an order starting with the center secondary slider 22 and ending with the two outermost secondary sliders 22 (i.e., the sixth one-side secondary slider 22 and the sixth other-side secondary slider 22) in the punch stacking direction DR1.

As shown in FIGS. 1 and 3, the primary stopper 30 is fixed integrally with the primary base 12. When the primary sliders 20 are individually moved toward the other side in the slider reciprocating direction DR3, the other-side end surfaces 203 of the primary sliders 20 abut against the primary stopper 30.

Furthermore, as shown in FIG. 1, at the stroke end of the primary sliders 20 located at the other side in the slider reciprocating direction DR3, a portion 204 of each of the primary sliders 20, which includes the other-side pressure receiving surface 202*b*, is clamped between the primary pressing shaft 241 and the primary stopper 30, so that the primary sliders 20 are arrested in the slider reciprocating direction DR3. In other words, every time when the primary pressing shaft 241 is placed at the stroke end located at the other side in the slider reciprocating direction DR3 in the reciprocating movement of the primary pressing shaft 241, the primary sliders 20 are clamped between the primary pressing shaft 241 and the primary stopper 30, so that the primary sliders 20 are arrested in a manner that limits movement of the primary sliders 20 in the slider reciprocating direction DR3.

As shown in FIG. 1, the secondary stopper 32 is fixed integrally with the secondary base 14. When the secondary sliders 22 are individually moved toward the other side in the slider reciprocating direction DR3, the other-side end surfaces 223 of the secondary sliders 22 abut against the secondary stopper 32.

Furthermore, as shown in FIG. 1, at the stroke end of the secondary sliders 22 located at the other side in the slider reciprocating direction DR3, a portion 224 of each of the secondary sliders 22, which includes the other-side pressure receiving surface 222*b*, is clamped between the secondary pressing shaft 242 and the secondary stopper 32, so that the secondary sliders 22 are arrested in the slider reciprocating direction DR3. In other words, every time when the secondary pressing shaft 242 is placed at the stroke end located at the other side in the slider reciprocating direction DR3 in the reciprocating movement of the secondary pressing shaft 242, the secondary sliders 22 are clamped between the secondary pressing shaft 242 and the secondary stopper 32, so that the secondary sliders 22 are arrested in a manner that limits movement of the secondary sliders 22 in the slider reciprocating direction DR3.

The primary slider support portion 34 is configured into a planar plate form, which extends in the slider reciprocating direction DR3. The primary slider support portion 34 is placed on an opposite side of the primary sliders 20, which is opposite from the primary base 12 in the top-to-bottom direction DR2. That is, the primary slider support portion 34 is placed on the lower side of the primary sliders 20. The primary slider support portion 34 is fixed to the primary base 12 together with the primary stopper 30. The primary slider support portion 34 clamps or holds the primary sliders 20 between the primary slider support portion 34 and the lower surface 121 of the primary base 12, so that the primary slider support portion 34 supports the primary sliders 20 in such a manner that the primary sliders 20 are movable in the slider reciprocating direction DR3 and are not movable in the top-to-bottom direction DR2.

The secondary slider support portion 36 is configured into a planar plate form, which extends in the slider reciprocating direction DR3. The secondary slider support portion 36 is placed on an opposite side of the secondary sliders 22, which is opposite from the secondary base 14 in the top-to-bottom direction DR2. That is, the secondary slider support portion 36 is placed on the upper side of the secondary sliders 22. The secondary slider support portion 36 is fixed to the secondary base 14 together with the secondary stopper 32. The secondary slider support portion 36 clamps or holds the secondary sliders 22 between the secondary slider support portion 36 and the upper surface 141 of the secondary base 14, so that the secondary slider support portion 36 supports the secondary sliders 22 in such a manner that the secondary sliders 22 are movable in the slider reciprocating direction DR3 and are not movable in the top-to-bottom direction DR2.

Figure 5:
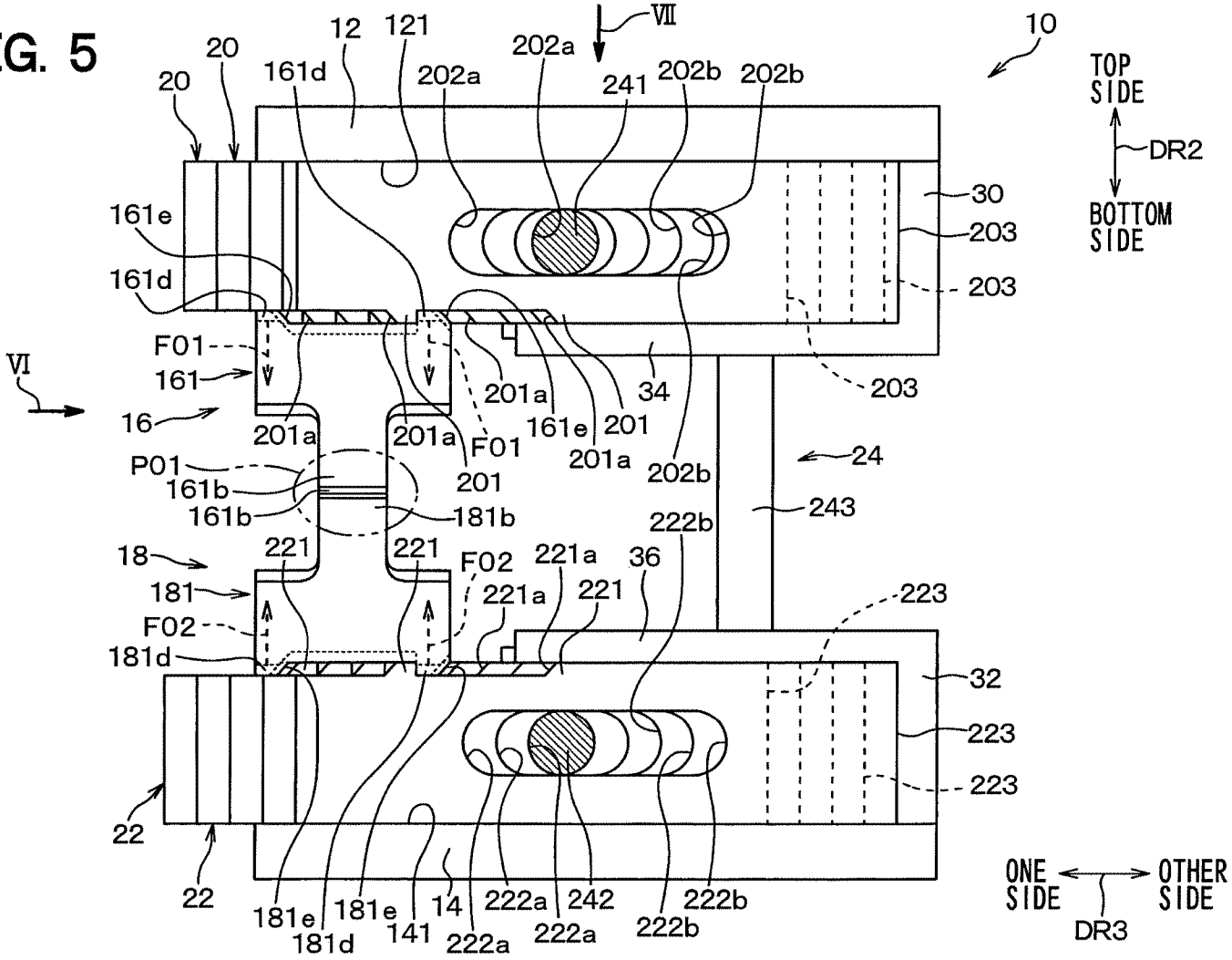
FIG. 5 is a front view of the corrugated plate manufacturing apparatus of the first embodiment taken in the same direction as that of FIG. 1, showing an operational state in the middle of stroke of a reciprocating arrangement of the corrugated plate manufacturing apparatus.
Figure 6:
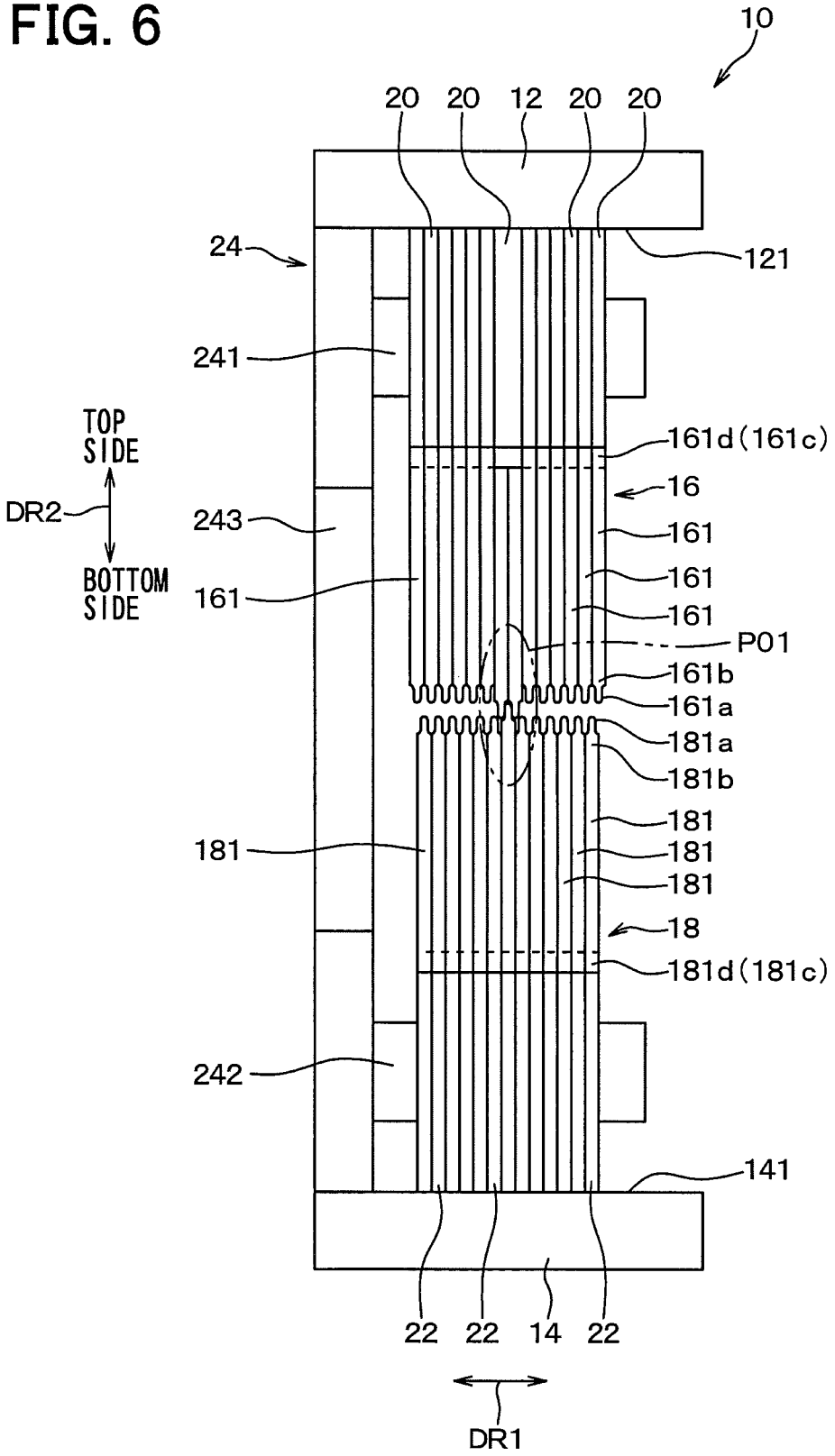
FIG. 6 is a view, which is taken in a direction of an arrow VI in FIG. 5 and is seen in the same direction as that of FIG. 2.
Figure 7:
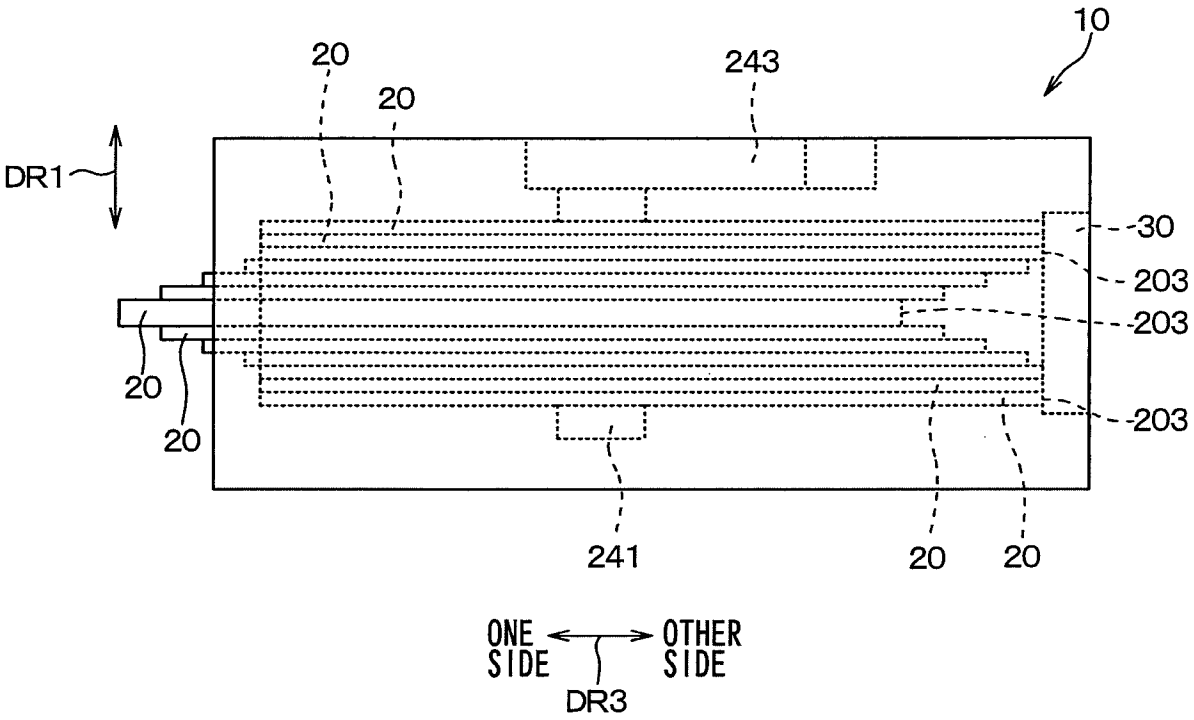
FIG. 7 is a plan view, which is taken in a direction of an arrow VII in FIG. 5.

Next, the operation of the corrugated plate manufacturing apparatus 10 will be described. First of all, when the material 92 of the inner fin 90 is inserted between the primary die 16 and the secondary die 18, the reciprocating arrangement 24 begins to move from the state where the reciprocating arrangement 24 is placed at the stroke end located at the other side in the slider reciprocating direction DR3, i.e., from the state shown in FIG. 1 toward the one side in the slider reciprocating direction DR3. When the reciprocating arrangement 24 is moved to the one side in the slider reciprocating direction DR3, the primary sliders 20 are sequentially moved by the primary pressing shaft 241 toward the one side in the slider reciprocating direction DR3, and the secondary sliders 22 are sequentially moved by the secondary pressing shaft 242 toward the one side in the slider reciprocating direction DR3. FIGS. 5 to 7 show the corrugated plate manufacturing apparatus 10 in the state where the stroke reciprocating arrangement 24 is in the middle of the stroke of the reciprocating arrangement 24. FIG. 5 is a front view of the corrugated plate manufacturing apparatus 10 seen in the direction, which is the same as that of FIG. 1, showing the corrugated plate manufacturing apparatus 10 in the state where the stroke reciprocating arrangement 24 is in the middle of the stroke of the reciprocating arrangement 24. FIG. 6 is a view, which is taken in a direction of an arrow VI in FIG. 5 and is seen in the same direction as that of FIG. 2. FIG. 7 is a view, which is taken in a direction of an arrow VII in FIG. 5 and is seen in the same direction as that of FIG. 3. In FIGS. 5 to 7 and FIGS. 8 to 10 described later, the material 92 of the inner fin 90 is omitted for the sake of simplicity.

In the state shown in FIGS. 5 to 7, only the center primary slider 20, which is centered in the row of the primary sliders 20 in the punch stacking direction DR1, and the center secondary slider 22, which is centered in the row of the secondary sliders 22 in the punch stacking direction DR1, are moved together with the primary pressing shaft 241 and the secondary pressing shaft 242 from the stroke end located at the other side in the slider reciprocating direction DR3 toward the one side in the slider reciprocating direction DR3. Furthermore, in the state shown in FIGS. 5 to 7, only the two center primary forming punches 161, which are centered in the row of the primary forming punches 161 in the punch stacking direction DR1, are pressed downward by the corresponding center primary slider 20 toward the secondary die 18, and only one center secondary forming punch 181, which is centered in the row of the secondary forming punches 181 in the punch stacking direction DR1, is pressed upward by the corresponding center secondary slider 22 toward the primary die 16. In this way, as indicated in an area P01 in FIGS. 5 and 6, the two center primary forming punches 161, which are centered in the row of the primary forming punches 161 in the punch stacking direction DR1, and the center secondary forming punch 181, which is centered in the row of the secondary forming punches 181 in the punch stacking direction DR1, are engaged with each other to plastically deform a corresponding portion of the material 92 of the inner fin 90 into the form of the corrugated pattern.

Figure 8:
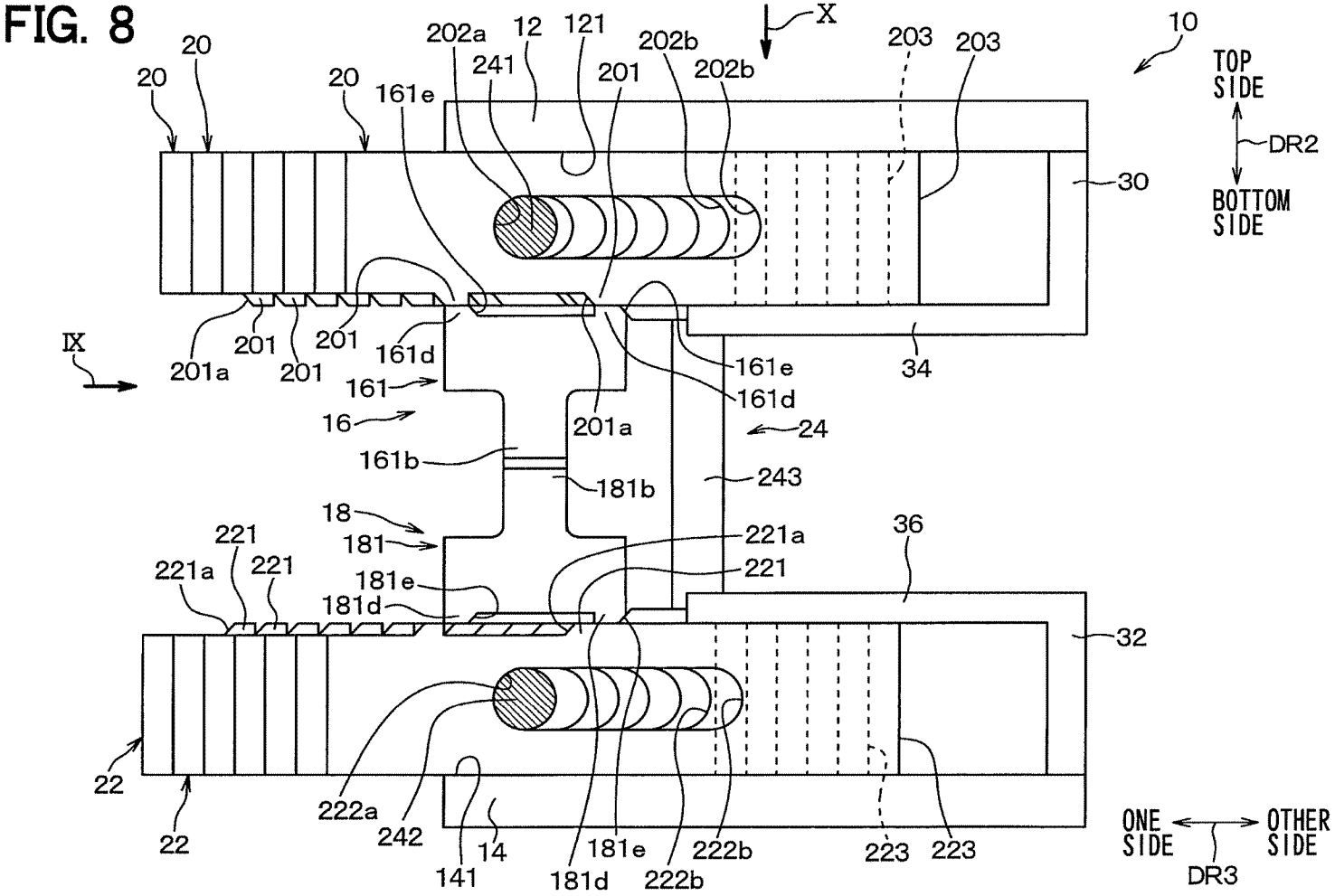
FIG. 8 is a front view of the corrugated plate manufacturing apparatus of the first embodiment taken in the same direction as that of FIG. 1, showing an operational state, in which the reciprocating arrangement is placed at a stroke end location at one side in a slider reciprocating direction.
Figure 9:
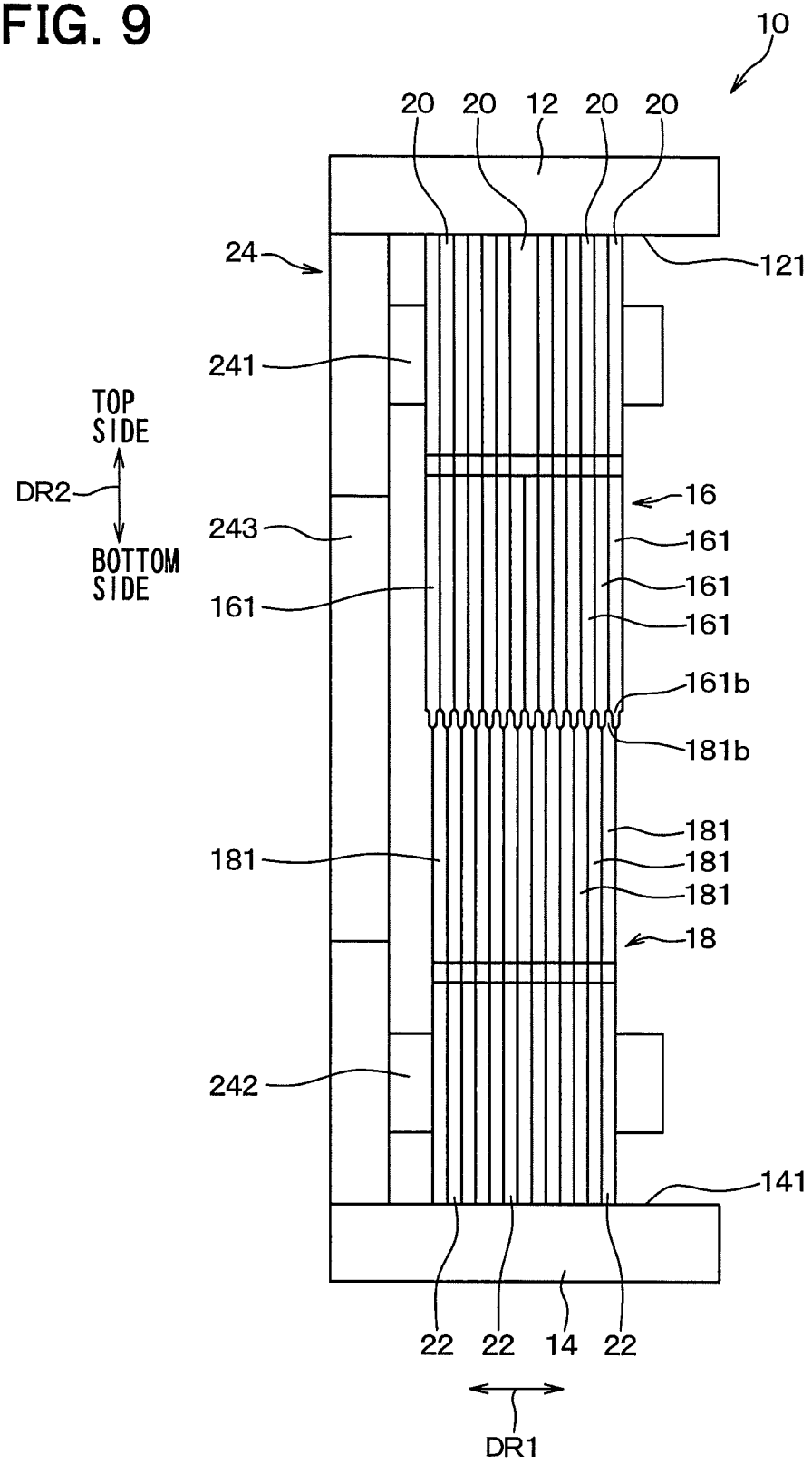
FIG. 9 is a left side view, which is taken in a direction of an arrow IX in FIG. 8 and is seen in the same direction as that of FIG. 2.
Figure 10:
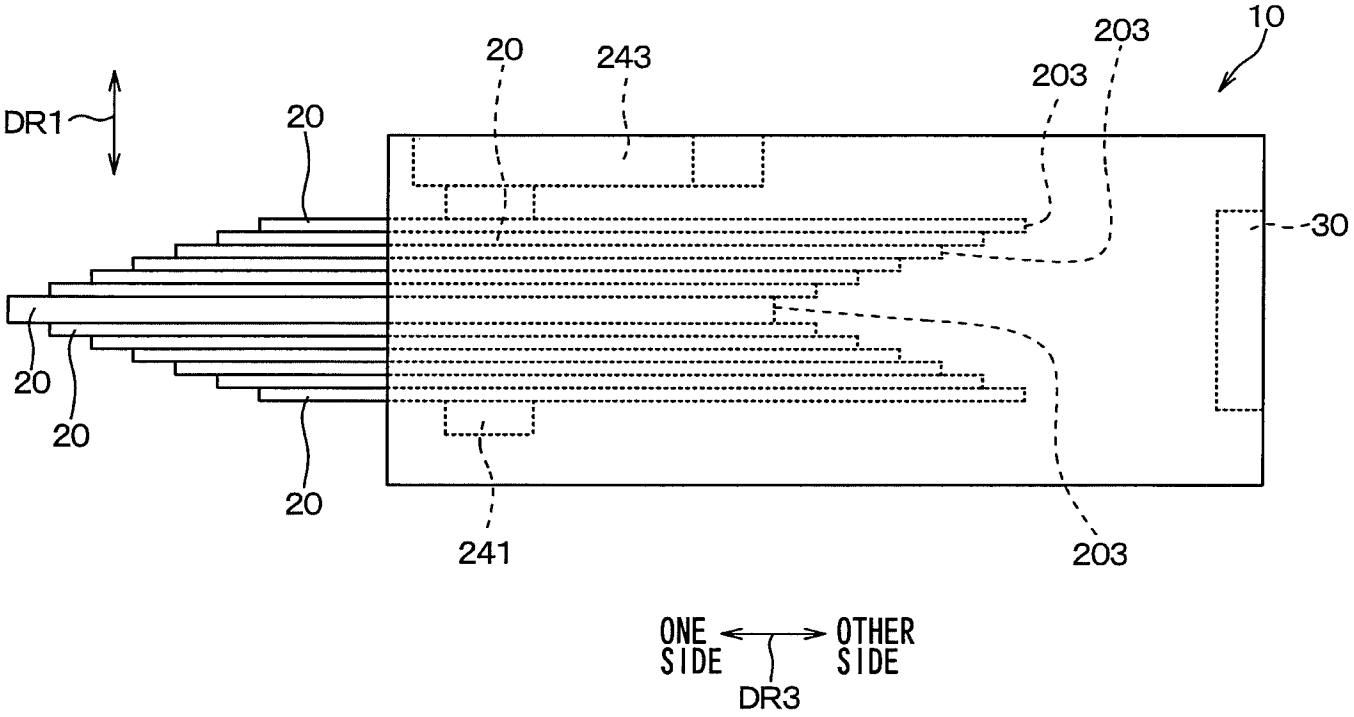
FIG. 10 is a plan view, which is taken in a direction of an arrow X in FIG. 8 and is seen in the same direction as that of FIG. 3.

FIGS. 8 to 10 indicate a state where the reciprocating arrangement 24 is placed at the stroke end located at the one side in the slider reciprocating direction DR3 after the reciprocating arrangement 24 is further moved from the state shown in FIGS. 5 to 7 toward the one side in the slider reciprocating direction DR3 until the reciprocating arrangement 24 reaches the stroke end located at the one side in slider reciprocating direction DR3. FIG. 8 is a front view of the corrugated plate manufacturing apparatus 10 seen in the direction, which is the same as that of FIG. 1, showing the corrugated plate manufacturing apparatus 10 in the state where the stroke reciprocating arrangement 24 is at the stroke end located at the one side in the slider reciprocating direction DR3. FIG. 9 is a view, which is taken in a direction of an arrow IX in FIG. 8 and is seen in the same direction as that of FIG. 2. FIG. 10 is a view, which is taken in a direction of an arrow X in FIG. 8 and is seen in the same direction as that of FIG. 3.

In the state shown in FIGS. 8 to 10, since the reciprocating arrangement 24 is placed at the stroke end located at the one side in the slider reciprocating direction DR3, all of the primary sliders 20 are spaced from the stroke end located at the other side in the slider reciprocating direction DR3 and press the primary forming punches 161 downward toward the secondary die 18. At the same time, all of the secondary sliders 22 are spaced from the stroke end located at the other side in the slider reciprocating direction DR3 and press the secondary forming punches 181 upward toward the primary die 16. Thus, all of the primary forming punches 161 are pressed downward by the primary sliders 20 toward the secondary die 18, and all of the secondary forming punches 181 are pressed upward by the secondary sliders 22 toward the primary die 16. In this way, the process of plastically deforming the material 92 of the inner fin 90 into the corrugated pattern through the engagement of all of the primary forming punches 161 and all of the secondary forming punches 181 together is completed.

As discussed above, the position of the one-side pressure receiving surface 202*a* in the slider reciprocating direction DR3 is set differently for each corresponding one of the primary sliders 20. Thereby, the operational timing of each of the primary sliders 20 is shifted from the operational timing of the previously moved primary slider 20 (the adjacent primary slider 20 located on the center side in the row of the primary sliders 20 in the punch stacking direction DR1) or the operational timing of the subsequently moved primary slider 20 (the adjacent primary slider 20 located on the outer side in the row of the primary sliders 20 in the punch stacking direction DR1). Also, the position of the one-side pressure receiving surface 222*a* in the slider reciprocating direction DR3 is set differently for each corresponding one of the secondary sliders 22. Thereby, the operational timing of each of the secondary sliders 22 is shifted from the operational timing of the previously moved secondary slider 22 (the adjacent secondary slider 22 located on the center side in the row of the secondary sliders 22 in the punch stacking direction DR1) or the operational timing of the subsequently moved secondary slider 22 (the adjacent secondary slider 22 located on the outer side in the row of the secondary sliders 22 in the punch stacking direction DR1).

Therefore, when the primary sliders 20 are sequentially moved toward the one side in the slider reciprocating direction DR3 at the different operational timing, each corresponding one of the primary sliders 20 presses the primary pressable portions 161*d* of the corresponding one of the primary forming punches 161 to press the primary forming punch 161 against the secondary die 18 at corresponding press timing, which corresponds to the operational timing of the primary slider 20. Here, the press timing of each currently pressed primary forming punch 161 is shifted from the press timing of the previously pressed primary forming punch 161 (the adjacent primary forming punch 161 located on the center side in the row of the primary forming punches 161 in the punch stacking direction DR1) or the press timing of the subsequently pressed primary forming punch 161 (the adjacent primary forming punch 161 located on the outer side in the row of the primary forming punches 161 in the punch stacking direction DR1) by the corresponding amount that corresponds to the amount of shift between the operational timing of the currently moved primary slider 20, which presses the currently pressed primary forming punch 161, and the operational timing of the previously moved primary slider 20, which presses the previously pressed primary forming punch 161, or the operational timing of the subsequently moved primary slider 20, which presses the subsequently pressed primary forming punch 161.

At the same time, when the secondary sliders 22 are sequentially moved toward the one side in the slider reciprocating direction DR3 at the different operational timing, each corresponding one of the secondary sliders 22 presses the secondary pressable portions 181*d* of the corresponding one of the secondary forming punches 181 to press the secondary forming punch 181 against the primary die 16 at corresponding press timing, which corresponds to the operational timing of the secondary slider 22. Here, the press timing of each currently pressed secondary forming punch 181 is shifted from the press timing of the previously pressed secondary forming punch 181 (the adjacent secondary forming punch 181 located on the center side in the row of the secondary forming punches 181 in the punch stacking direction DR1) or the press timing of the subsequently pressed secondary forming punch 181 (the adjacent secondary forming punch 181 located on the outer side in the row of the secondary forming punches 181 in the punch stacking direction DR1) by the corresponding amount that corresponds to the amount of shift between the operational timing of the currently moved secondary slider 22, which presses the currently pressed secondary forming punch 181, and the operational timing of the previously moved secondary slider 22, which presses the previously pressed secondary forming punch 181, or the operational timing of the subsequently moved secondary slider 22, which presses the subsequently pressed secondary forming punch 181. The press timing of each of the secondary forming punches 181 is different from the press timing of the corresponding opposed one of the primary forming punches 161. For instance, in the case of FIG. 6, the center secondary forming punch 181, which is centered in the row of the secondary forming punches 181 in the punch stacking direction DR1, is pressed upward by the corresponding secondary slider 22, and thereafter, the two center primary forming punches 161, which are centered in the row of the primary forming punches 161 in the punch stacking direction DR1, are pressed downward by the corresponding primary slider 20 at slightly delayed timing.

Furthermore, as shown in FIG. 5, when each of the primary sliders 20 is moved toward the one side in the slider reciprocating direction DR3, the pressable surfaces 161*e* of the two primary pressable portions 161*d* of the corresponding primary forming punch 161 are pressed by the two pressing tilt surfaces 201*a* of the primary slider 20. As discussed above, the pressable surfaces 161*e* and the pressing tilt surfaces 201*a* are tilted relative to both of the top-to-bottom direction DR2 and slider reciprocating direction DR3. Therefore, when each of the pressable surfaces 161*e* is pressed by the corresponding one of the pressing tilt surfaces 201*a*, the pressable surface 161*e* generates a component force F01, which presses the primary forming punch 161 against the secondary die 18 and is derived from a pressing force applied from the pressing tilt surface 201*a* to the pressable surface 161*e*. That is, the primary pressing shaft 241 generates the component force F01 by pressing the primary slider 20 toward the one side in the slider reciprocating direction (the third direction) DR3.

The above discussion is also applicable to the secondary die 18. Therefore, when each of the secondary sliders 22 is moved toward the one side in the slider reciprocating direction DR3, the pressable surfaces 181*e* of the two secondary pressable portions 181*d* of the corresponding secondary forming punch 181 are pressed by the two pressing tilt surfaces 221*a* of the secondary slider 22. When each of the pressable surfaces 181*e* of the secondary forming punch 181 is pressed by the corresponding one of the pressing tilt surfaces 221*a* of the corresponding secondary slider 22, the pressable surface 181*e* generates a component force F02, which presses the secondary forming punch 181 against the primary die 16 and is derived from a pressing force applied from the pressing tilt surface 221*a* to the pressable surface 181*e*. The material 92 of the inner fin 90 is plastically deformed by these component forces F01, F02.

As shown in FIGS. 8 to 10, when the reciprocating arrangement 24 reaches the stroke end located at the one side in the slider reciprocating direction DR3, the reciprocating arrangement 24 is moved from the stroke end located at the one side in the slider reciprocating direction DR3 toward the other side in the slider reciprocating direction DR3. In response to this movement of the reciprocating arrangement 24, the primary pressing shaft 241 presses the other-side pressure receiving surfaces 202*b* of the primary sliders 20 to sequentially return the primary sliders 20 to the original position shown in FIG. 1, and the secondary pressing shaft 242 presses the other-side pressure receiving surfaces 222*b* of the secondary sliders 22 to sequentially return the secondary sliders 22 to the original position shown in FIG. 1.

As discussed above, according to the present embodiment, the primary sliders 20 are sequentially driven at the different operational timing to press the multiple primary pressable portions 161*d* of the corresponding primary forming punch 161, so that the primary forming punches 161 are sequentially pressed against the secondary die 18 at the corresponding press timing. Here, the press timing of each currently pressed primary forming punch 161 is shifted from the press timing of the previously pressed primary forming punch 161 or the press timing of the subsequently pressed primary forming punch 161 by the corresponding amount that corresponds to the amount of shift between the operational timing of the currently moved primary slider 20, which presses the currently pressed primary forming punch 161, and the operational timing of the previously moved primary slider 20, which presses the previously pressed primary forming punch 161, or the operational timing of the subsequently moved primary slider 20, which presses the subsequently pressed primary forming punch 161. The primary pressing shaft 241 sequentially drives the primary sliders 20 at the different operational timing toward the one side in the slider reciprocating direction DR3. That is, the operational timing of each currently moved primary slider 20 is shifted (is changed) from the operational timing of the previously moved primary slider 20 or is shifted from the operational timing of the subsequently moved primary slider 20. Since the press timing of the currently pressed primary forming punch 161 is shifted from the press timing of the previously pressed primary forming punch 161 or the press timing of the subsequently pressed primary forming punch 161, it is not required to offset the primary pressing portions 201 in the slider reciprocating direction DR3 unlike the sliders 944 of the upper die shown in FIG. 27. Therefore, in comparison to the structure (see FIG. 27) of the slider 944 of the upper die of the previously proposed corrugated plate manufacturing apparatus, it is possible to reduce the interval between the pressable portions 161*d* of each of the stacked primary forming punches 161.

Figure 26:
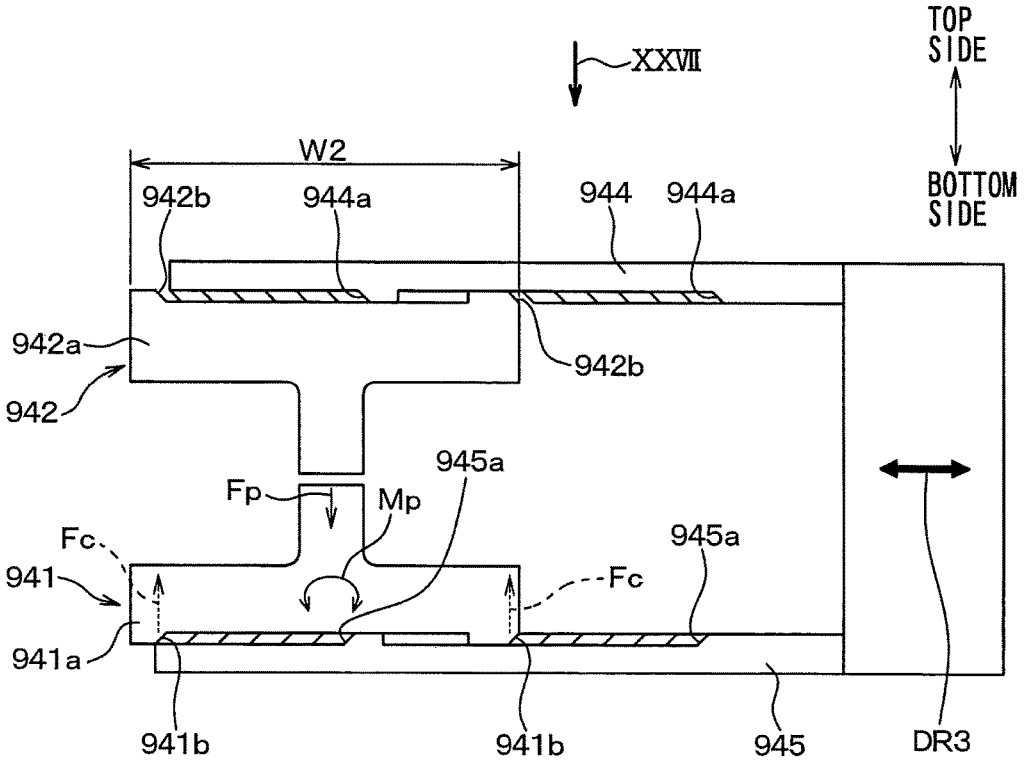
FIG. 26 RELATED ART
FIG. 26 is a front view of a previously proposed first corrugated plate manufacturing apparatus.
Figure 27:
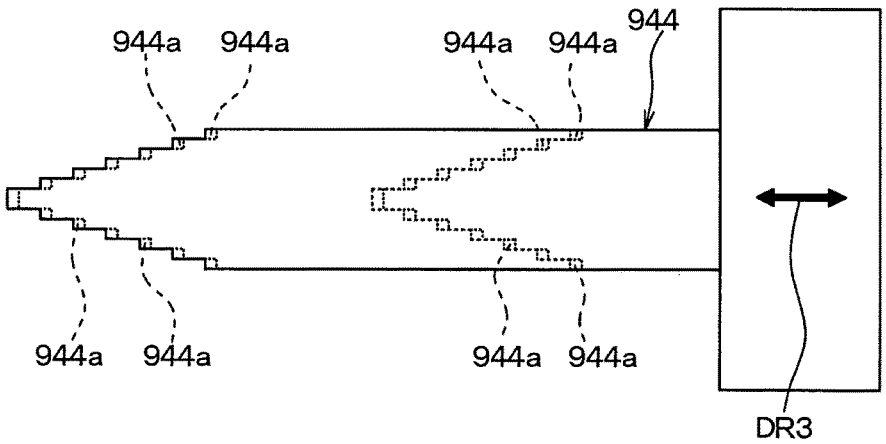
FIG. 27 RELATED ART
FIG. 27 is a view taken in a direction of an arrow XXVII in FIG. 26.
Figure 28:
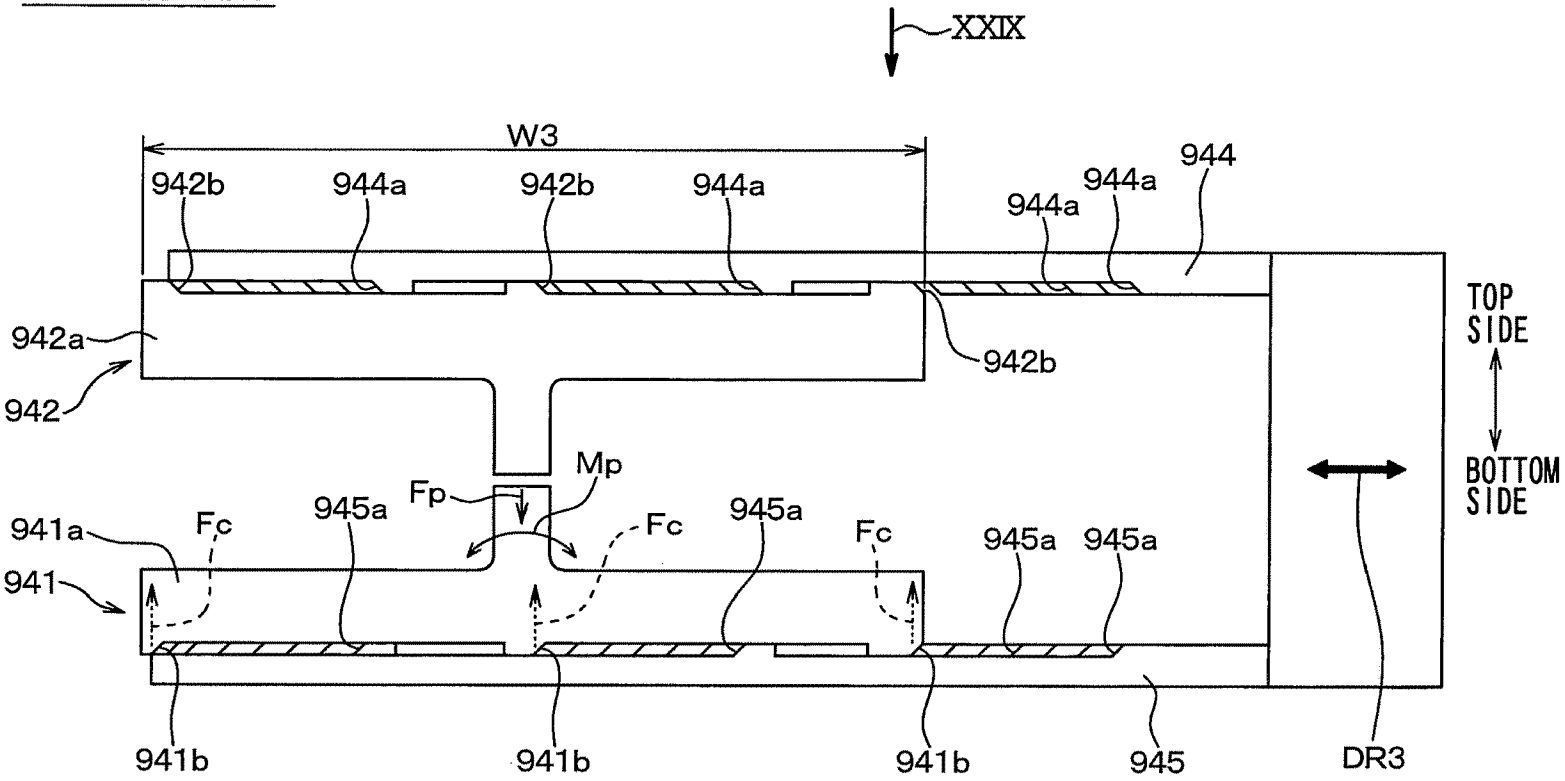
FIG. 28 RELATED ART
FIG. 28 is a front view of a previously proposed second corrugated plate manufacturing apparatus.
Figure 29:
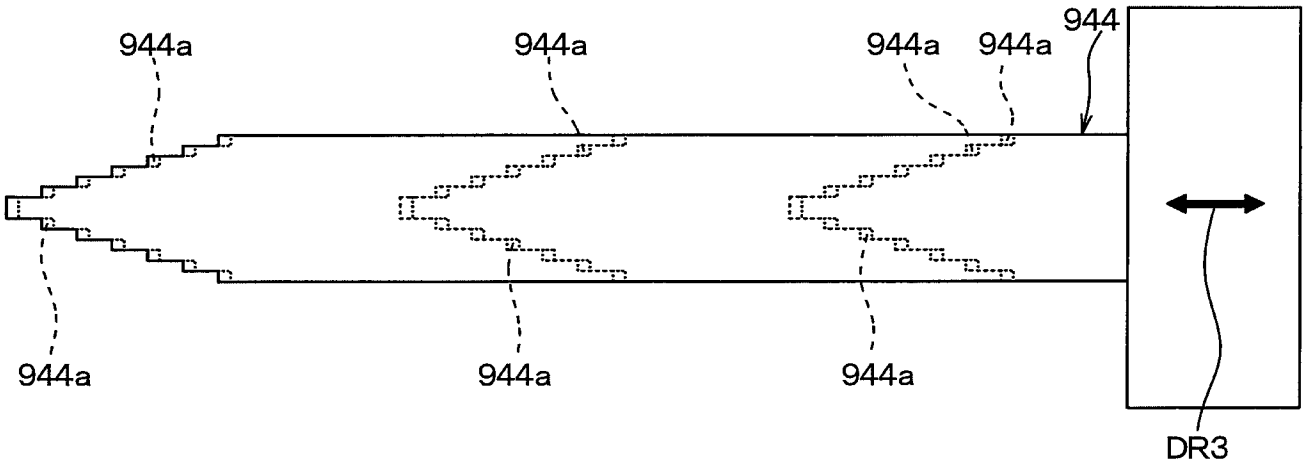
FIG. 29 RELATED ART
FIG. 29 is a view taken in a direction of an arrow XXIX in FIG. 28.

That is, in the corrugated plate manufacturing apparatus 10 of the present embodiment, the primary sliders 20 are separately formed and are thereby not integrally formed unlike the previously proposed corrugated plate manufacturing apparatus shown in FIGS. 26 and 27. Therefore, when the reciprocating arrangement 24 is in the initial position at the stroke end located at the other side in the slider reciprocating direction DR3, the locations of the two primary pressing portions (serving as cam portions) 201 in the slider reciprocating direction DR3 are identical among the respective primary sliders 20. As a result, a width Ws2 (see FIG. 1) of an area occupied by the two primary pressable portions (serving as cam portions) 161*d* at each primary forming punch 161 can be limited or minimized.

Furthermore, according to the present embodiment, each of the primary sliders 20 includes the one-side pressure receiving surface 202*a*, which is pressed by the primary pressing shaft 241 toward the one side in the slider reciprocating direction DR3, and the other-side pressure receiving surface 202*b*, which is pressed by the primary pressing shaft 241 toward the other side in the slider reciprocating direction DR3. Therefore, the press timing for pressing the primary pressable portions 161*d* of the primary forming punch 161 with the primary pressing portions 201 of the corresponding primary slider 20 can be determined according to the location of the one-side pressure receiving surface 202*a* of the primary slider 20. Also, the release timing for releasing the primary pressable portions 161*d* of the primary forming punch from the pressing force of the primary pressing portions 201 of the corresponding primary slider 20 can be determined according to the location of the other-side pressure receiving surface 202*b* of the primary slider 20.

In other words, in the case where the locations of the one-side pressure receiving surfaces 202*a* in the slider reciprocating direction DR3 are displaced from one another among the primary sliders 20, the operational timing of each of the primary sliders 20 for moving the primary slider 20 toward the one side in the slider reciprocating direction DR3 can be shifted from the operational timing of the previously moved primary slider 20 (the adjacent primary slider 20 located on the center side in the row of the primary sliders 20 in the punch stacking direction DR1) or the operational timing of the subsequently moved primary slider 20 (the adjacent primary slider 20 located on the outer side in the row of the primary sliders 20 in the punch stacking direction DR1). Thereby, the forming timing of each ridge or furrow formed in the material 92 of the inner fin 90 by the plastic deformation can be determined independently of the locations of the primary pressing portions 201.

Furthermore, according to the present embodiment, the positional relationship of the one-side pressure receiving surface 202*a* relative to each primary pressing portion 201 in the slider reciprocating direction DR3 is set differently for each corresponding one of the primary sliders 20. Thereby, the primary forming punches 161 can be pressed downward at the different timing (different time points). That is, the press timing of each primary forming punch 161 can be shifted from the press timing of the previously pressed primary forming punch 161 (the adjacent primary forming punch 161 located on the center side in the row of the primary forming punches 161 in the punch stacking direction DR1) or the press timing of the subsequently pressed primary forming punch 161 (the adjacent primary forming punch 161 located on the outer side in the row of the primary forming punches 161 in the punch stacking direction DR1).

Furthermore, according to the present embodiment, in any outer one of the primary sliders 20, which is placed on the outer side in the row of the primary sliders 20 in the punch stacking direction DR1, the one-side pressure receiving surface 202*a* is further displaced toward the one side in the slider reciprocating direction DR3 with reference to the reference position, which is the position of one of the two primary pressing portions 201 of the primary slider 20. In other words, in the state where all of the primary sliders 20 is placed at the stroke end of the primary sliders 20 located at the other side in the slider reciprocating direction DR3, the one-side pressure receiving surface 202*a* of the outer one of every adjacent two of the primary sliders 20, which is placed on the outer side of the other one of the adjacent two of the primary sliders 20 in the punch stacking direction DR1, is located on the one side of the one-side pressure receiving surface 202*a* of the other one of the adjacent two of the primary sliders 20 in the slider reciprocating direction DR3. Therefore, the primary forming punches 161 can be sequentially driven downward by the primary sliders 20 in an order starting with the two center primary forming punches 161, which are centered in the row of the primary forming punches 161 in the punch stacking direction DR1, and ending with the two outermost primary forming punches 161 in the punch stacking direction DR1.

Furthermore, according to the present embodiment, when each of the pressable surfaces 161*e* is pressed by the corresponding one of the pressing tilt surfaces 201*a*, the pressable surface 161*e* generates the component force F01, which presses the primary forming punch 161 against the secondary die 18 and is derived from the pressing force applied from the pressing tilt surface 201*a* to the pressable surface 161*e*. Therefore, although a die opening direction of the press forming die device, which includes the primary die 16 and the secondary die 18, is the top-to-bottom direction DR2, the primary sliders 20 can be reciprocated in the direction, which is perpendicular to the die opening direction, i.e., can be reciprocated in the slider reciprocating direction DR3.

Furthermore, according to the present embodiment, the one-side pressure receiving surface 202*a* is formed to oppose the other-side pressure receiving surface 202*b* in the slider reciprocating direction DR3 in each primary slider 20 while the primary pressing shaft 241 is interposed between the one-side pressure receiving surface 202*a* and the other-side pressure receiving surface 202*b*. Therefore, the primary slider drive portion, which reciprocates the primary sliders 20, can be formed by the column member like the primary pressing shaft 241 of the present embodiment. Thereby, the mechanism of shifting the operational timing of each primary slider 20 from the operational timing of the other primary slider(s) 20 can be easily constructed.

Furthermore, according to the present embodiment, as shown in FIG. 1, at the stroke end of the primary sliders 20 located at the other side in the slider reciprocating direction DR3, the portion 204 of each of the primary sliders 20, which includes the other-side pressure receiving surface 202*b*, is clamped between the primary pressing shaft 241 and the primary stopper 30, so that the primary sliders 20 are arrested in the slider reciprocating direction DR3. Therefore, the movement of the primary sliders 20 in the slider reciprocating direction DR3 can be stopped every time the primary pressing shaft 241 reaches the stroke end, which is located at the other side in the slider reciprocating direction DR3, in the reciprocating movement of the primary pressing shaft 241. Thus, the primary pressing shaft 241 can sequentially and smoothly push the primary sliders 20 at the time of moving the primary pressing shaft 241 toward the one side in the slider reciprocating direction DR3 from the stroke end located at the other side. That is, the unnecessary movement of the primary sliders 20 is limited, and thereby generation of the vibrations from the corrugated plate manufacturing apparatus 10 can be limited.

Furthermore, according to the present embodiment, the primary pressing shaft 241 is moved integrally with the secondary pressing shaft 242. Therefore, the movement of each primary forming punch 161 and the movement of each secondary forming punch 181 can be mechanically synchronized.

Furthermore, in the state where the reciprocating arrangement 24 is placed at the stroke end located at the other side in the slider reciprocating direction DR3, i.e., in the state shown in FIG. 1, each of the pressing tilt surfaces 201*a* of each primary slider 20 is spaced from the corresponding one of the pressable surfaces 161*e* of the corresponding primary forming punch 161 by the spacing distance Td in the slider reciprocating direction DR3. Therefore, the feeding time period for feeding the material 92 of the inner fin 90 between the primary forming punches 161 and the secondary forming punches 181 can be provided by stopping the movement of the primary die 16 and the secondary die 18 in the top-to-bottom direction while continuously reciprocating the reciprocating arrangement 24 in the slider reciprocating direction DR3 at each shot executed with the primary die 16 and the secondary die 18. That is, the movement of the primary die 16 and the secondary die 18 in the top-to-bottom direction can be temporarily stopped in each press forming operation of the inner fin 90 without stopping the reciprocating movement of the reciprocating arrangement 24, so that the press forming operation of the inner fin 90 can be executed one after another.

Although the advantages of the present embodiment have been described with respect to the primary die 16 side, the above discussed advantages with respect to the primary die 16 side are also achieved with the secondary die 18 side.

Second Embodiment

Next, a second embodiment of the present disclosure will be described. In the following description of the second embodiment, differences of the second embodiment will be mainly described, and the portions, which are similar to those of the first embodiment, will not be described for the sake of simplicity.

Figure 11:
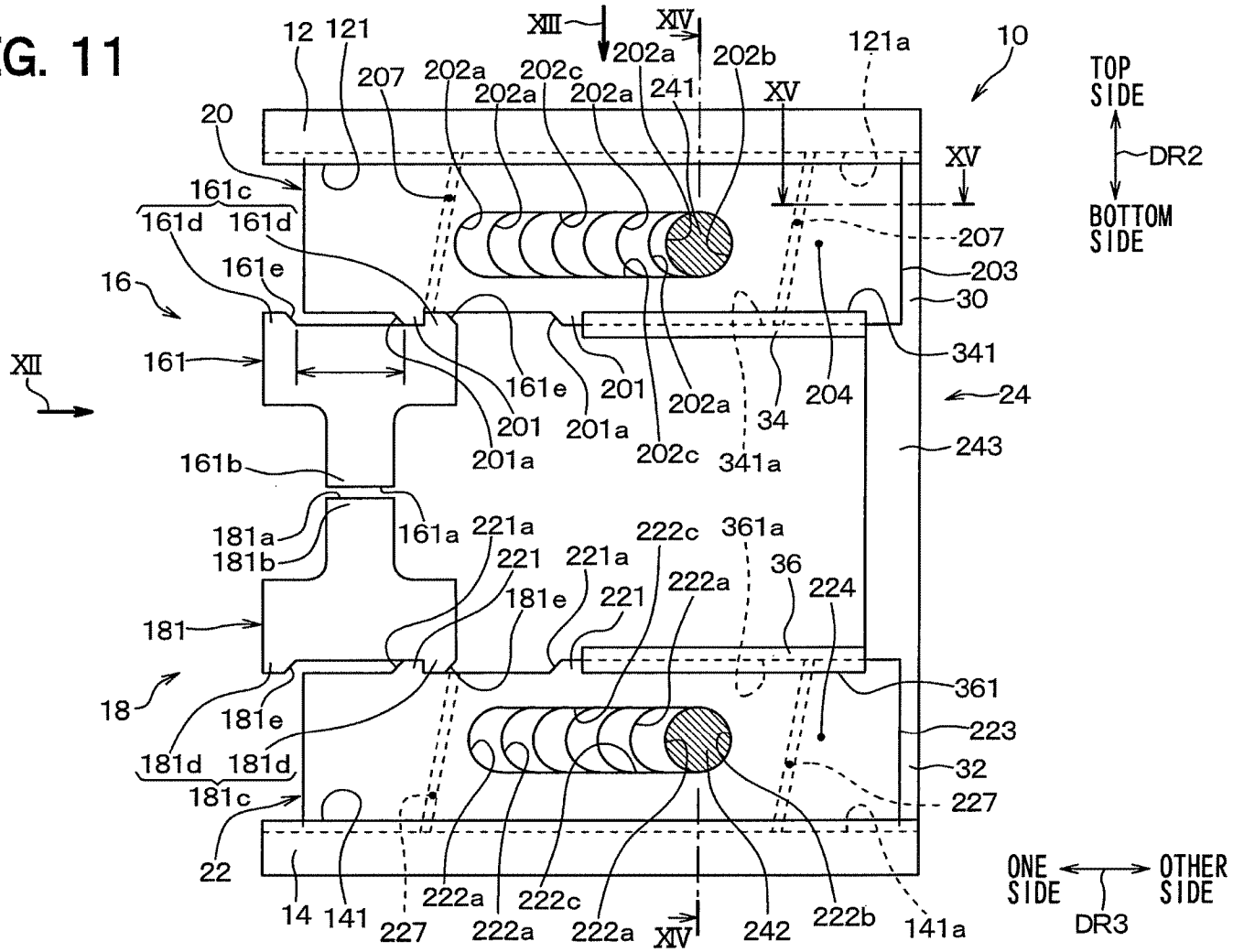
FIG. 11 is a front view of a corrugated plate manufacturing apparatus according to a second embodiment of the present disclosure and corresponds to FIG. 1.
Figure 12:
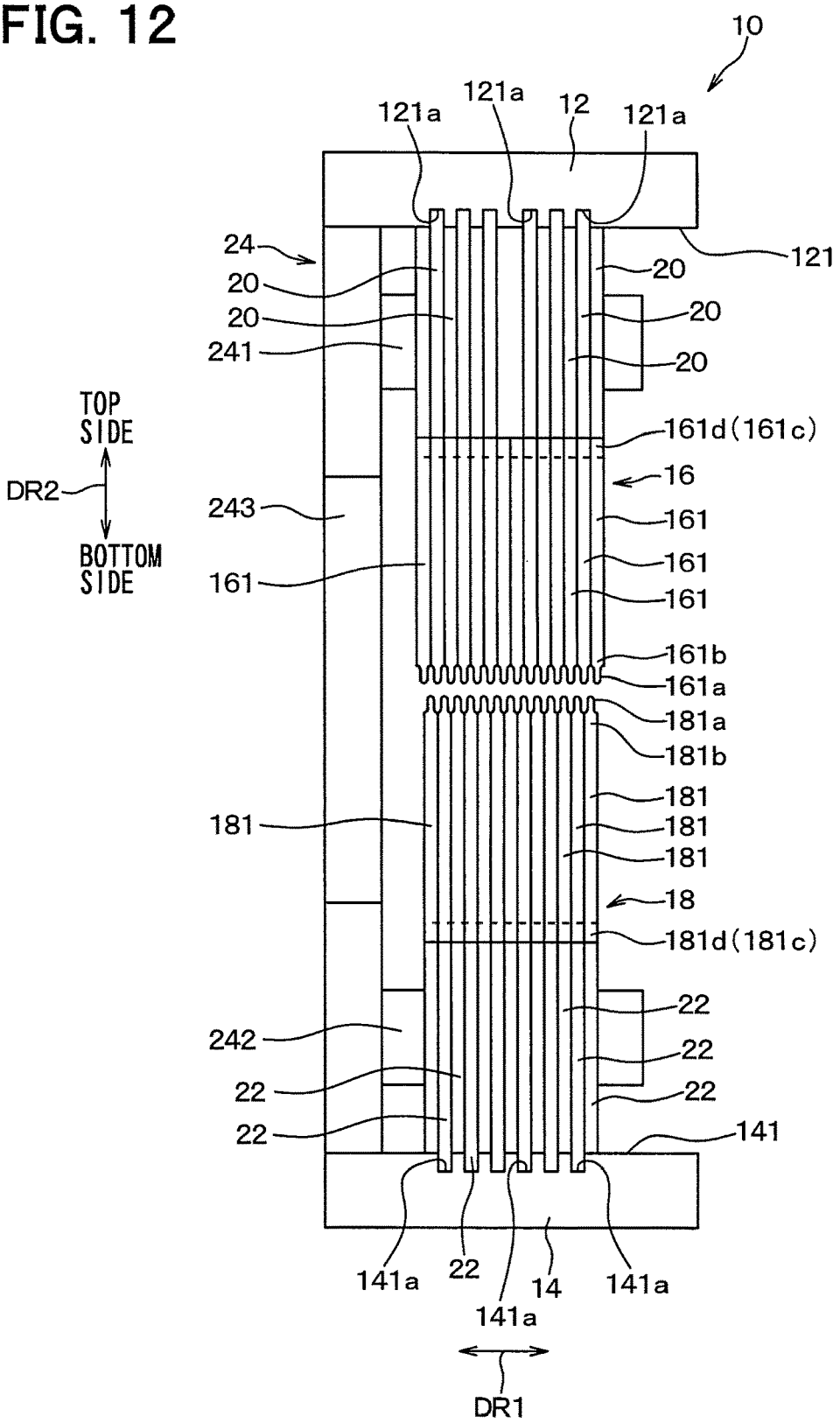
FIG. 12 is a left side view of the corrugated plate manufacturing apparatus of the second embodiment taken in a direction of an arrow XII in FIG. 11.

FIG. 11 is a front view of a corrugated plate manufacturing apparatus according to the second embodiment of the present disclosure and corresponds to FIG. 1. Furthermore, FIG. 12 is a left side view of the corrugated plate manufacturing apparatus of the second embodiment taken in a direction of an arrow XII in FIG. 11. As shown in FIGS. 11 and 12, in the present embodiment, the configuration of the guide structure, which guides the sliders 20, 22, and the configuration of the side surfaces 206, 226 of the primary and secondary sliders 20, 22 are different from those of the first embodiment.

Figure 13:
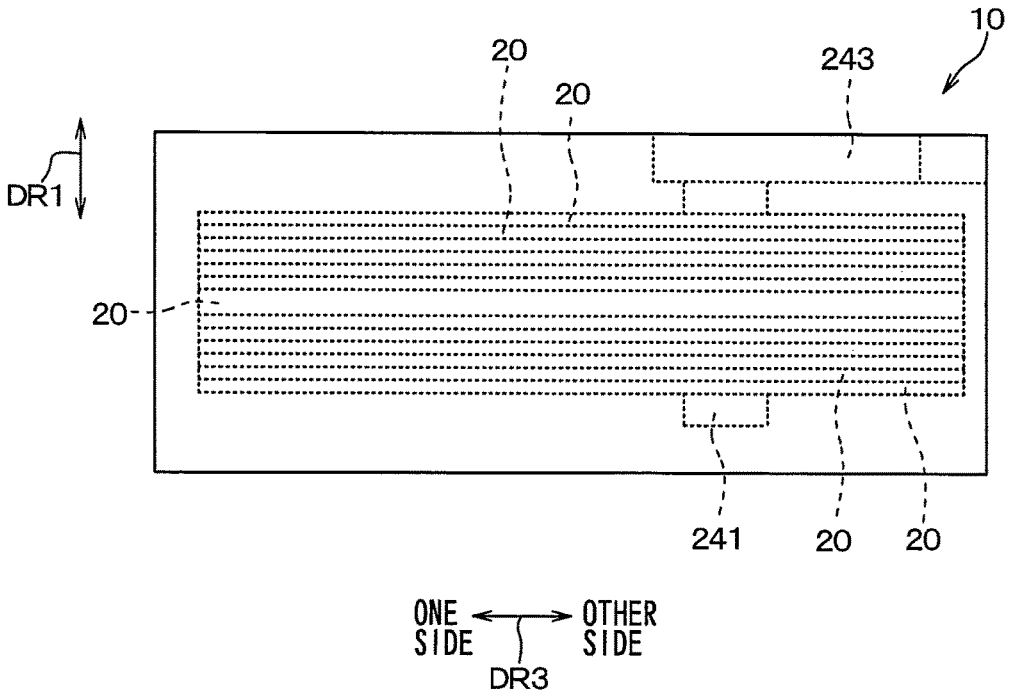
FIG. 13 is a plan view of the corrugated plate manufacturing apparatus of the second embodiment taken in a direction of an arrow XIII in FIG. 11.

The corrugated plate manufacturing apparatus 10 of the present embodiment does not have the stoppers 30, 32, as shown in FIGS. 11 and 13 (FIG. 13 is a view taken in a direction of an arrow XIII in FIG. 11). However, the corrugated plate manufacturing apparatus 10 of the present embodiment may have the stoppers 30, 32, like in the first embodiment, if desired. Although the primary slider support portion 34 and the secondary slider support portion 36 are depicted separately from the primary base 12 and the secondary base 14, respectively, in FIG. 11, the primary slider support portion 34 is fixed to the primary base 12, and the secondary slider support portion 36 is fixed to the secondary base 14 like in the first embodiment.

As shown in FIGS. 11 and 12, a plurality (six in this instance) of base guide grooves 121*a*, which extend in the slider reciprocating direction DR3, is formed in the lower surface 121 of the primary base 12. The base guide grooves 121*a* serve as one-side grooves, which are located on one side of the primary sliders 20 in the top-to-bottom direction DR2. The base guide grooves 121*a* are parallel to each other and are arranged one after another in the punch stacking direction DR1. Corresponding ones (six primary sliders 20) of the of primary sliders 20 are respectively, movably fitted into the base guide grooves 121*a* to enable movement of the corresponding ones of the primary sliders 20 in the slider reciprocating direction DR3. That is, since the base guide grooves 121*a* guide the corresponding primary sliders 20 (the six primary sliders 20), which are respectively fitted into the base guide grooves 121*a*, the primary base 12 serves as a one-side guide portion.

Furthermore, a plurality (seven in this instance) of support portion guide grooves 341*a*, which extend in the slider reciprocating direction DR3, is formed in an upper surface 341 of the primary slider support portion 34. The support portion guide grooves 341*a* serve as other-side grooves (also referred to as another-side grooves), which are located on the other side (another side) of the primary sliders 20, which is opposite from the one side in the top-to-bottom direction DR2. The support portion guide grooves 341*a* are parallel to each other and are arranged one after another in the punch stacking direction DR1. Corresponding different ones (remaining seven primary sliders 20) of the primary sliders 20, which are different from the corresponding ones (the six primary sliders 20) of the primary sliders 20, are respectively, movably fitted into the support portion guide grooves 341*a* to enable movement of the corresponding different ones of the primary sliders 20 in the slider reciprocating direction DR3. That is, since the support portion guide grooves 341*a* of the primary slider support portion 34 guide the corresponding different primary sliders 20 (the seven primary sliders 20), which are respectively fitted into the support portion guide grooves 341*a*, the primary slider support portion 34 serves as an other-side guide portion (also referred to as another-side guide portion).

Figure 14:
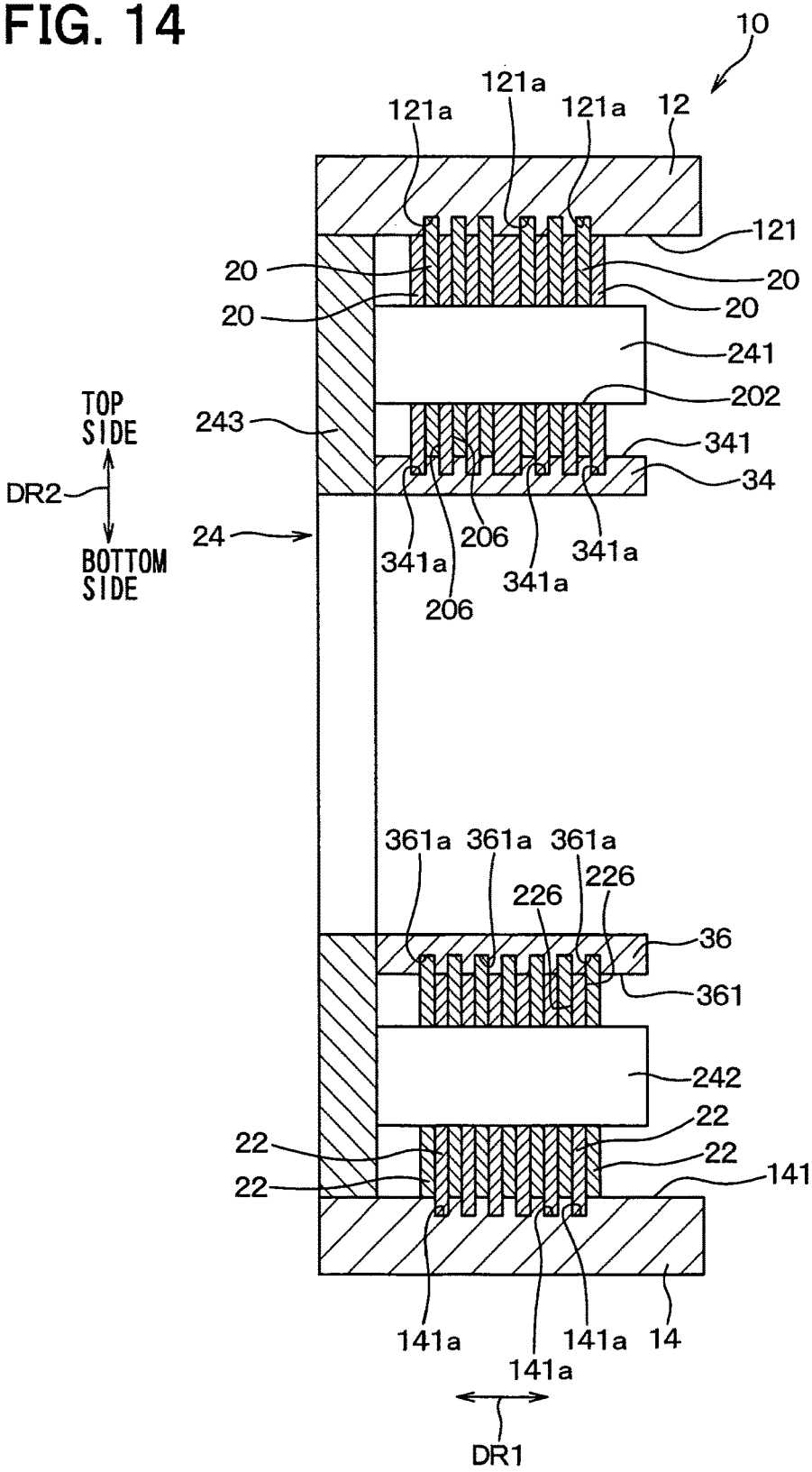
FIG. 14 is a cross sectional view taken along line XIV-XIV in FIG. 11.

As shown in FIGS. 12 and 14, the primary sliders 20, which are fitted into the base guide grooves 121*a* of the primary base 12, and the primary sliders 20, which are fitted into the support portion guide grooves 341*a* of the primary slider support portion 34, are alternately stacked in the punch stacking direction DR1. The primary sliders 20 are guided in the slider reciprocating direction DR3 in the above-described manner, so that an increase in the width of the corrugated plate manufacturing apparatus 10 in the punch stacking direction DR1 is limited, and a positional deviation of each of the primary sliders 20 in the punch stacking direction DR1 is limited. Thereby, it is possible to easily avoid occurrence of dragging of each primary slider 20 by the adjacent primary slider 20 to limit unintentional downward movement of the corresponding primary forming punch 161 by the dragged primary slider 20. FIG. 14 is a cross sectional view taken along line XIV-XIV in FIG. 11.

The secondary sliders 22 are guided in a manner similar to that of the primary sliders 20 discussed above. Specifically, a plurality of base guide grooves 141*a*, which serve as one-side guide grooves, are formed in the upper surface 141 of the secondary base 14, and a plurality of support portion guide grooves 361*a*, which serve as other-side guide grooves (also referred to as another-side guide grooves), is formed in a lower surface 361 of the secondary slider support portion 36. Corresponding ones (six secondary sliders 22) of the of secondary sliders 22 are respectively, movably fitted into the base guide grooves 141*a* to enable movement of the corresponding ones of the secondary sliders 22 in the slider reciprocating direction DR3. Also, corresponding different ones (remaining seven secondary sliders 22) of the secondary sliders 22, which are different from the corresponding ones (the six secondary sliders 22) of the secondary sliders 22, are respectively, movably fitted into the support portion guide grooves 361*a* to enable movement of the corresponding different ones of the secondary sliders 22 in the slider reciprocating direction DR3. The secondary sliders 22, which are fitted into the base guide grooves 141*a* of the secondary base 14, and the secondary sliders 22, which are fitted into the support portion guide grooves 361*a* of the secondary slider support portion 36, are alternately stacked in the punch stacking direction DR1.

Figure 15:
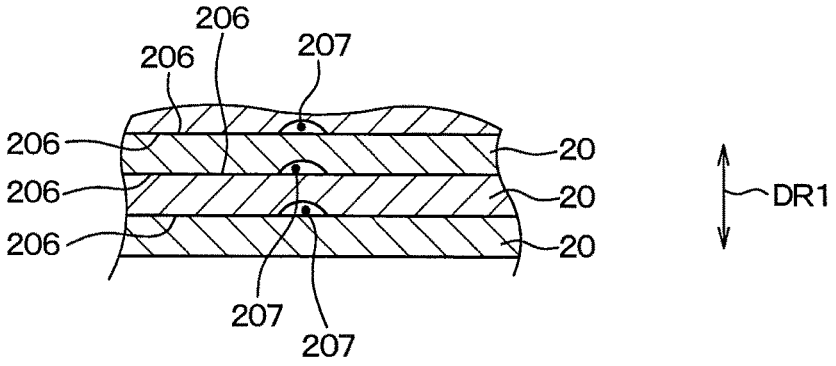
FIG. 15 is a partial enlarged cross sectional view taken along line XV-XV in FIG. 11.

Furthermore, as shown in FIGS. 11 and 15 (FIG. 15 is a view taken along line XV-XV in FIG. 11), one of the two side surfaces 206 of each primary slider 20, which are placed at two opposite sides, respectively, of the primary slider 20 in the punch stacking direction DR1, is formed with a plurality of oil grooves 207. The oil grooves 207 receive lubricant oil that provides lubrication to movement of the primary sliders 20. Each of the oil grooves 207 extends through the primary slider 20 in the top-to-bottom direction DR2 and has a cross section that is slightly recessed from the corresponding side surface 206 in the thickness direction of the primary slider 20, as shown in FIG. 15.

The secondary sliders 22 are also formed in a manner similar to the one discussed above with reference to the primary sliders 20. Specifically, one of the two side surfaces 226 (see FIG. 14) of each secondary slider 22, which are placed at two opposite sides, respectively, of the secondary slider 22 in the punch stacking direction DR1, is formed with a plurality of oil grooves 227 (see FIG. 11), which are similar to the oil grooves 207 of the primary sliders 20. The oil grooves 227 receive lubricant oil that provides lubrication to movement of the secondary sliders 22. The lubricant oil is continuously supplied from a lubricant oil supply device, which is placed at an outside of the corrugated plate manufacturing apparatus 10, to the oil grooves 207 of the primary sliders 20 and the oil grooves 227 of the secondary sliders 22.

Since the oil grooves 207, 227 are formed in the primary sliders 20 and the secondary sliders 22, the lubricant oil can be more widely supplied to the side surfaces 206, 226 of the primary sliders 20 and the secondary sliders 22 in comparison to the case where the oil grooves 207, 227 are absent. Therefore, generation of, for example, heat caused by slide friction between the adjacent primary sliders 20 or slide friction between the adjacent secondary sliders 22 can be sufficiently limited.

Now, modifications of the above embodiments will be described.

(1) In the second embodiment, the oil grooves 207 of each primary slider 20 are provided only in the one of the two side surfaces 206 of the primary slider 20. Alternatively, the oil grooves 207 may be formed in each of the two side surfaces 206 of the primary slider 20. This is also applicable to the oil grooves 227 of each secondary slider 22.

Figure 16:
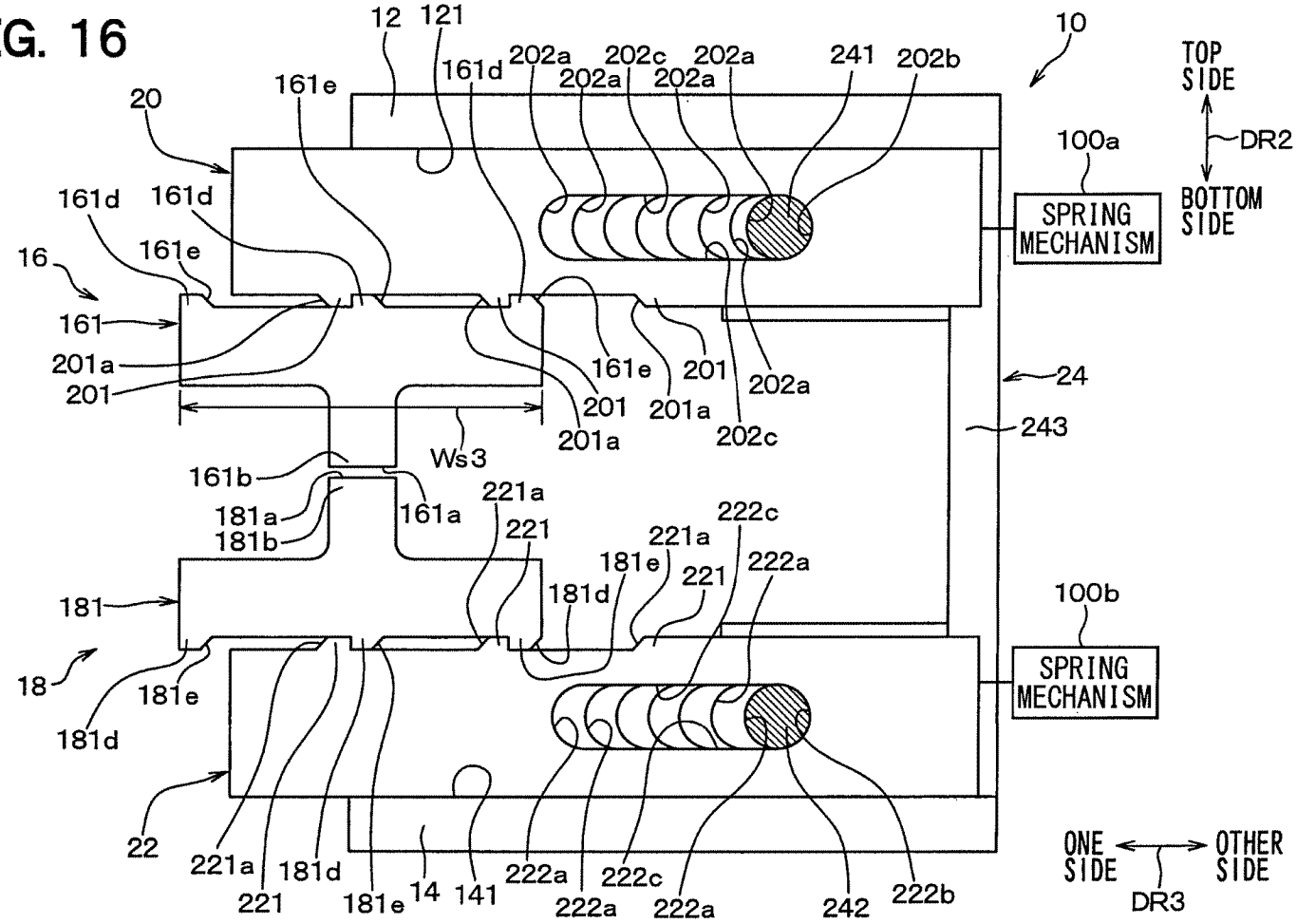
FIG. 16 is a front view showing a modification of the corrugated plate manufacturing apparatus of the first embodiment.

(2) In each of the above embodiments, the two primary pressable portions 161*d* are formed at the two locations of each primary forming punch 161, and the two secondary pressable portions 181*d* are formed at the two locations of each secondary forming punch 181. However, the number of the primary pressable portions 161*d* formed in each primary forming punch 161 is not limited to two and may be changed to three or more. Also, the number of the secondary pressable portions 181*d* formed in each secondary forming punch 181 is not limited to two and may be changed to three or more. FIG. 16 shows a modification of the corrugated plate manufacturing apparatus 10 of the first embodiment, in which each primary forming punch 161 has three primary pressable portions 161*d* respectively formed at three locations in the primary forming punch 161, and each secondary forming punch 181 has three secondary pressable portions 181*d* respectively formed at three locations in the secondary forming punch 181. FIG. 16 is a front view showing the modification of the corrugated plate manufacturing apparatus of the first embodiment and corresponds to FIG. 1. In the corrugated plate manufacturing apparatus 10 of FIG. 16, the number of the primary pressable portions 161*d* and the number of the secondary pressable portions 181*d* are larger than those of the corrugated plate manufacturing apparatus 10 of FIG. 1. Therefore, in the corrugated plate manufacturing apparatus 10 of FIG. 16, for example, a width Ws3 of an area occupied by the three primary pressable portions 161*d* at each primary forming punch 161 is larger than the width Ws1 of FIG. 1, which corresponds to the width Ws3. This is also applicable to the three secondary pressable portions 181*d* of each secondary forming punch 181.

(3) In each of the above embodiments, each primary forming punch 161 is driven by the cam mechanism in the direction away from the secondary die 18 synchronously with releasing of the pressing force applied from the corresponding primary slider 20 against the primary forming punch 161. For example, alternative to the cam mechanism, a spring mechanism may be provided to urge each of the primary forming punches 161 in the direction away from the secondary die 18. This is also applicable to the secondary forming punches 181.

(4) In each of the above embodiments, both of the primary die 16 and the secondary die 18 are formed as movable dies that are movable in the top-to-bottom direction DR2. Alternatively, one of the primary die 16 and the secondary die 18 may be formed as a movable die, and the other one of the primary die 16 and the secondary die 18 may be formed as a stationary die that does not move relative to the corresponding base 12, 14. In such a stationary die, it is not necessary to divide the forming punches from each other.

(5) In each of the above embodiments, the press forming die device, which includes the primary die 16 and the secondary die 18, makes the opening and closing movements in the top-to-bottom direction DR2. However, the opening and closing movements of the press forming die device is not necessarily in the top-to-bottom direction DR2. That is, the opening and closing movements of the press forming die device may be made in any direction other than the top-to-bottom direction DR2.

(6) In each of the above embodiments, each of the primary pressing shaft 241 and the secondary pressing shaft 242 is formed as the column member. However, the shape of each of the primary pressing shaft 241 and the secondary pressing shaft 242 is not limited to such a shape. For example, one or both of the primary pressing shaft 241 and the secondary pressing shaft 242 may be formed into a planar plate form, if desired.

(7) In each of the above embodiments, the one-side pressure receiving surface 202*a* and the other-side pressure receiving surfaces 202*b* of each primary slider 20 are formed as the parts of the through-hole 202. However, the one-side pressure receiving surface 202*a* and the other-side pressure receiving surfaces 202*b* of each primary slider 20 are not necessarily the parts of the hole of the primary slider 20 and may be changed to any appropriate form. This is also applicable to each of the secondary sliders 22.

(8) In each of the above embodiments, a primary spring mechanism (serving as a primary urging mechanism) 100*a* may be provided to urge each of the primary sliders 20 toward the other side in the slider reciprocating direction DR3, as indicated in FIG. 16. The spring mechanism 100*a* may include a plurality of springs, each of which urges a corresponding one of the primary sliders 20 toward the other side in the slider reciprocating direction DR3 to limit excess movement (excess inertial movement) of the primary slider 20 toward the one side in the slider reciprocating direction DR3 when the primary slider 20 is pressed by the primary pressing shaft 241 toward the one side in the slider reciprocating direction DR3. Each spring of the spring mechanism 100*a* pulls the corresponding primary slider 20 toward the other side in the slider reciprocating direction DR3. Alternatively, each spring of the spring mechanism 100*a* may push the corresponding primary slider 20 toward the other side in the slider reciprocating direction DR3. Also, a primary spring mechanism (serving as a secondary urging mechanism) 100*b* may be provided to urge each of the secondary sliders 22 toward the other side in the slider reciprocating direction DR3. The spring mechanism 100*b* may include a plurality of springs, each of which urges a corresponding one of the secondary sliders 22 toward the other side in the slider reciprocating direction DR3 to limit excess movement (excess inertial movement) of the secondary slider 22 toward the one side in the slider reciprocating direction DR3 when the secondary slider 22 is pressed by the secondary pressing shaft 242 toward the one side in the slider reciprocating direction DR3. Each spring of the spring mechanism 100*b* may pull the corresponding secondary slider 22 toward the other side in the slider reciprocating direction DR3. Alternatively, Each spring of the spring mechanism 100*b* may push the corresponding secondary slider 22 toward the other side in the slider reciprocating direction DR3.

The present disclosure is not limited to the above embodiments, and the above embodiments may be modified in various ways within the scope of the present disclosure. Furthermore, in each of the above embodiments, some components discussed above may be eliminated unless the components are expressly indicated as indispensable components or are obviously considered as indispensable components in view of the principle of the present disclosure. Furthermore, in each of the above embodiments, in the case where the number of the component(s), the value, the amount, the range, or the like is specified, the present disclosure is not limited to the number of the component(s), the value, the amount, or the like specified in the embodiment unless the number of the component(s), the value, the amount, or the like is indicated as indispensable or is obviously indispensable in view of the principle of the present disclosure. Furthermore, in each of the above embodiments, in the case where the material of the component(s), the shape of the component(s), and/or the positional relationship of the component(s) are specified, the present disclosure is not limited to the material of the component(s), the shape of the component(s), and/or the positional relationship of the component(s) unless the embodiment specifically states that the material of the component(s), the shape of the component(s), and/or the positional relationship of the component(s) is necessary, or the embodiment states that the present disclosure is limited in principle to the material of the component(s), the shape of the component(s), and/or the positional relationship of the component(s) discussed above.

What is claimed is:

1. A corrugated plate manufacturing apparatus for forming a corrugated metal plate product that has a corrugated pattern, which includes alternating ridges and furrows that are continuously and alternately arranged one after another, the corrugated plate manufacturing apparatus comprising:

a primary die that includes a plurality of primary forming punches, which are stacked one after another in a first direction;

a secondary die that opposes the primary die in a second direction, which is perpendicular to the first direction, wherein the secondary die clamps a material of the corrugated metal plate product between the primary die and the secondary die to deform the material of the corrugated metal plate product and thereby to form the corrugated pattern, which includes the alternating ridges and furrows continuously and alternately arranged one after another in the first direction in the material of the corrugated metal plate product, at a time of forming the corrugated metal plate product;

a plurality of primary sliders that are arranged one after another in the first direction such that each of the plurality of primary sliders corresponds to each corresponding one of the plurality of primary forming punches, wherein the plurality of primary sliders is movable in a third direction, which intersects the first direction and the second direction; and a primary slider drive portion that sequentially drives the plurality of primary sliders toward one side in the third direction, wherein:

each of the plurality of primary forming punches includes a plurality of primary pressable portions that are arranged one after another in the third direction and are pressable by a corresponding one of the plurality of primary sliders; and when the plurality of primary sliders is sequentially moved toward the one side in the third direction, each corresponding one of the plurality of primary sliders presses the plurality of primary pressable portions of each corresponding one of the plurality of primary forming punches to press the primary forming punch against the secondary die.

2. The corrugated plate manufacturing apparatus according to claim 1, wherein:

each of the plurality of primary sliders includes:

a one-side pressure receiving surface, which is pressable by the primary slider drive portion toward the one side in the third direction; and an another-side pressure receiving surface, which is pressable by the primary slider drive portion toward another side, which is opposite from the one side in the third direction;

the primary slider drive portion is reciprocatable in the third direction;

the primary slider drive portion drives each corresponding one of the plurality of primary sliders toward the one side in the third direction by pressing the one-side pressure receiving surface of the primary slider; and the primary slider drive portion drives each corresponding one of the plurality of primary sliders toward the another side in the third direction by pressing the another-side pressure receiving surface of the primary slider.

3. The corrugated plate manufacturing apparatus according to claim 2, wherein:

each of the plurality of primary sliders includes a primary pressing portion that presses a corresponding one of the plurality of primary pressable portions of the corresponding one of the plurality of primary forming punches; and a positional relationship between the one-side pressure receiving surface and the primary pressing portion in the third direction is set differently for each corresponding one of the plurality of primary sliders.

4. The corrugated plate manufacturing apparatus according to claim 3, wherein in a state where all of the plurality of primary sliders is placed at a stroke end of the plurality of primary sliders located at the another side in the third direction, the one-side pressure receiving surface of an outer one of every adjacent two of the plurality of primary sliders, which is placed on an outer side of another one of the adjacent two of the plurality of primary sliders in the first direction, is located on the one side of the one-side pressure receiving surface of the another one of the adjacent two of the plurality of primary sliders in the third direction.

5. The corrugated plate manufacturing apparatus according to claim 3, wherein a positional relationship between the another-side pressure receiving surface and the primary pressing portion in the third direction is set to be identical for each of the plurality of primary sliders.

6. The corrugated plate manufacturing apparatus according to claim 3, wherein:

the primary pressing portion of each of the plurality of primary sliders has a pressing tilt surface that is tilted relative to both of the second direction and the third direction;

in each of the plurality of primary forming punches, the corresponding one of the plurality of primary pressable portions has a pressable surface that is directed in an opposing direction, along which the pressable surface of the primary pressable portion is opposed to the pressing tilt surface of the corresponding one of the plurality of primary sliders; and in each of the plurality of primary forming punches, when the corresponding one of the plurality of primary sliders is moved toward the one side in the third direction, the pressable surface of the primary pressable portion is pressed by the pressing tilt surface of the corresponding one of the plurality of primary sliders and generates a component force, which presses the primary forming punch against the secondary die and is derived from a pressing force applied from the pressing tilt surface to the pressable surface of the primary pressable portion.

7. The corrugated plate manufacturing apparatus according to claim 6, wherein when the primary slider drive portion contacts the another-side pressure receiving surface of each of the plurality of primary sliders, the pressing tilt surfaces of the plurality of primary sliders overlap with each other in the first direction.

8. The corrugated plate manufacturing apparatus according to claim 2, wherein in each of the plurality of primary sliders, the one-side pressure receiving surface is opposed to the another-side pressure receiving surface in the third direction while the primary slider drive portion is interposed between the one-side pressure receiving surface and the another-side pressure receiving surface in the third direction.

9. The corrugated plate manufacturing apparatus according to claim 8, further comprising a stopper, against which each of the plurality of primary sliders is abuttable when the primary slider is moved toward the another side in the third direction, wherein the primary slider drive portion clamps a portion of each of the plurality of primary sliders, which includes the another-side pressure receiving surface, between the primary slider drive portion and the stopper at a stroke end of the plurality of primary sliders located at the another side in the third direction to arrest the plurality of primary sliders in the third direction.

10. The corrugated plate manufacturing apparatus according to claim 1, further comprising:

a one-side guide portion that is placed on one side of the plurality of primary sliders in the second direction, wherein the one-side guide portion includes a plurality of one-side grooves, in which corresponding ones of the plurality of primary sliders are respectively, movably fitted to enable movement of the corresponding ones of the plurality of primary sliders in the third direction; and an another-side guide portion that is placed on another side of the plurality of primary sliders, which is opposite from the one side in the second direction, wherein the another-side guide portion includes a plurality of another-side grooves, in which corresponding different ones of the plurality of primary sliders being different from the corresponding ones of the plurality of primary sliders are respectively, movably fitted to enable movement of the corresponding different ones of the plurality of primary sliders in the third direction; and the corresponding ones of the plurality of primary sliders, which are respectively fitted into the plurality of one-side grooves, and the different ones of the plurality of primary sliders, which are respectively fitted into the plurality of another-side grooves, are alternately stacked one after another in the first direction.

11. The corrugated plate manufacturing apparatus according to claim 1, wherein:

each of the plurality of primary sliders includes two side surfaces, which are placed at two opposite sides, respectively, of the primary slider in the first direction; and at least one of the two side surfaces of each of the plurality of primary sliders is formed with an oil groove, which receives lubricant oil that provides lubrication to movement of the primary slider.

12. The corrugated plate manufacturing apparatus according to claim 1, comprising:

a plurality of secondary sliders that are arranged one after another in the first direction and are movable in the third direction; and a secondary slider drive portion that sequentially drives the plurality of secondary sliders toward the one side in the third direction, wherein:

the secondary die includes a plurality of secondary forming punches, which are stacked one after another in the first direction;

each of the plurality of secondary forming punches includes a plurality of secondary pressable portions that are arranged one after another in the third direction and are pressable by a corresponding one of the plurality of secondary sliders;

each of the plurality of secondary sliders is formed to correspond with each corresponding one of the plurality of secondary forming punches;

when the plurality of secondary sliders is sequentially moved toward the one side in the third direction, each corresponding one of the plurality of secondary sliders presses the plurality of secondary pressable portions of each corresponding one of the plurality of secondary forming punches to press the secondary forming punch against the primary die; and the secondary slider drive portion moves integrally with the primary slider drive portion.

13. The corrugated plate manufacturing apparatus according to claim 1, wherein the primary slider drive portion sequentially drives the plurality of primary sliders toward the one side in the third direction in an order starting with a center one of the plurality of primary sliders, which is centered in the first direction, and ending with two outermost ones of the plurality of primary sliders, which are located on one side and another side, respectively, of the center one of the plurality of primary sliders in the first direction and are farthest from the center one of the plurality of primary sliders in the first direction.

14. The corrugated plate manufacturing apparatus according to claim 1, further comprising:

a primary urging mechanism that urges each of the plurality of primary sliders toward another side, which is opposite from the one side in the third direction; and a secondary urging mechanism that urges each of the plurality of secondary sliders toward the another side, which is opposite from the one side in the third direction.

* * * * *